US008826820B2

(12) United States Patent
Brent et al.

(10) Patent No.: US 8,826,820 B2
(45) Date of Patent: Sep. 9, 2014

(54) HIGH ENERGY BLASTING

(75) Inventors: Geoffrey Frederick Brent, Valentine (AU); Tapan Goswami, Lakelands (AU); Michael John Noy, Cardiff South (AU); Peter Dare-Bryan, Perth (AU)

(73) Assignee: Orica International Pte Ltd, Singapore (SG)

( * ) Notice: Subject to any disclaimer, the term of this patent is extended or adjusted under 35 U.S.C. 154(b) by 173 days.

(21) Appl. No.: 13/641,222

(22) PCT Filed: Apr. 15, 2011

(86) PCT No.: PCT/AU2011/000438
§ 371 (c)(1),
(2), (4) Date: Mar. 8, 2013

(87) PCT Pub. No.: WO2011/127540
PCT Pub. Date: Oct. 20, 2011

(65) Prior Publication Data

US 2013/0152812 A1 Jun. 20, 2013

(30) Foreign Application Priority Data

Apr. 15, 2010 (AU) ..... 2010901602
Oct. 12, 2010 (AU) ..... 2010904553

(51) Int. Cl.
*F42D 3/04* (2006.01)
*F42D 1/055* (2006.01)

(52) U.S. Cl.
CPC . *F42D 3/04* (2013.01); *F42D 1/055* (2013.01)
USPC ..... 102/312; 102/311; 102/313

(58) Field of Classification Search
USPC ..... 102/311–313
See application file for complete search history.

(56) References Cited

U.S. PATENT DOCUMENTS 4,359,246 A 11/1982 Ricketts
4,366,987 A 1/1983 Ricketts et al.

(Continued)

FOREIGN PATENT DOCUMENTS

WO 2005/052499 A1 6/2005

OTHER PUBLICATIONS

Minchinton, Alan and Lynch, Peter M., Fragmentation and heave modelling using a coupled discrete element gas flow code, Rock Fragmentation by Blasting, Mohanty, 1996, Balkema: Rotterdam, (pp. 71-80), 10 pages.

(Continued)

*Primary Examiner* — Michael David
(74) *Attorney, Agent, or Firm* — Banner & Witcoff, Ltd.

(57) ABSTRACT

A method of blasting rock, in mining for recoverable material, comprising drilling blastholes in a blast zone loading the blastholes with explosives and then firing the explosives in the blastholes in a single cycle of drilling, loading and blasting. The blast zone comprises a high energy blast zone in which blastholes are partially loaded with a first explosive to provide a high energy layer of the high energy blast zone having a powder factor of at least 1.75 kg of explosive per cubic meter of unblasted rock in the high energy layer and in which at least some of those blastholes are also loaded with a second explosive to provide a low energy layer of the high energy blast zone between the high energy layer and the adjacent end of those blastholes, said low energy layer having a powder factor that is at least a factor of two lower than the powder factor of said high energy layer. The high energy blasting method provides improved rock fragmentation through increased explosive energy concentration while simultaneously alleviating deleterious environment blast effects.

39 Claims, 15 Drawing Sheets

(56) References Cited

U.S. PATENT DOCUMENTS

| | | | | |
|---|---|---|---|---|
| 4,440,447 | A | 4/1984 | Ricketts et al. | |
| 4,444,433 | A | 4/1984 | Ricketts | |
| 5,071,496 | A * | 12/1991 | Coursen et al. | 149/21 |
| 5,099,763 | A * | 3/1992 | Coursen et al. | 102/313 |
| 6,453,818 | B1 * | 9/2002 | Brent | 102/313 |
| 6,684,791 | B1 * | 2/2004 | Barnhart | 102/307 |
| 7,406,918 | B2 * | 8/2008 | Brent et al. | 102/312 |
| 7,707,939 | B2 * | 5/2010 | Brent et al. | 102/312 |
| 8,398,175 | B2 * | 3/2013 | Spathis et al. | 299/1.05 |
| 8,413,584 | B2 * | 4/2013 | Mills et al. | 102/333 |
| 8,631,744 | B2 * | 1/2014 | Brent et al. | 102/313 |
| 2004/0154492 | A1 * | 8/2004 | Barnhart | 102/475 |
| 2004/0159258 | A1 * | 8/2004 | Brent et al. | 102/311 |
| 2005/0066836 | A1 | 3/2005 | Levi | |
| 2007/0151471 | A1 * | 7/2007 | La Rosa et al. | 102/301 |
| 2007/0214990 | A1 * | 9/2007 | Barkley et al. | 102/275.8 |
| 2013/0147253 | A1 * | 6/2013 | Spathis et al. | 299/13 |
| 2013/0298795 | A1 * | 11/2013 | Brent et al. | 102/312 |

OTHER PUBLICATIONS

Minchinton, A. and Dare-Bryan, P., The Application of Computer Modelling for Blasting and Flow in Sublevel Caving Operations, Ninth Underground Operators' Conference, Perth, WA , Mar. 2005, (pp. 65-73), 9 pages.

International Search Report mailed Jul. 13, 2011 (PCT/AU2011/000438); ISA/AU.

* cited by examiner

HIGH ENERGY BLASTING

This application is a national stage application of co-pending PCT application PCT/AU2011/000438 filed Apr. 15, 2011. The disclosure of this application is expressly incorporated herein by reference in its entirety.

TECHNICAL FIELD

The present invention relates to a method of blasting, and is particularly concerned with high energy blasting for recoverable mineral.

BACKGROUND ART

In mining for recoverable minerals, blasting provides the first step in breaking and dislodging the host rock from its initial state in the ground. This is the case whether the mining is conducted largely as a surface, or open-cut operation, or largely as a subsurface, or underground, mining operation. Blasting for recoverable minerals may occur either in rock that largely comprises waste or overburden material or in rock comprising ore or other recoverable mineral which represents recoverable concentrations of the valuable mineral or minerals to be mined. In some cases, blasts may occur in both waste and recoverable mineral.

Mine productivity can be improved through blasting which achieves more effective breakage and/or movement of the rock. This may improve the efficiency of mining equipment such as excavators and haulage or conveying equipment. Furthermore, in the case of mining for metalliferous mineral, improved rock breakage may lead to improvements in performance and throughput of the downstream comminution and ore recovery processes. In particular, finer fragmentation may improve performance and throughput of the crushing and milling circuits, which are generally the most cost- and energy-intensive stages of rock processing for ore recovery. In addition to the physical size of the rock fragments, it is believed that weakening of the inherent structural strength of the rock may further improve crushing and grinding performance. The creation of macro- and micro-fractures in the blasting process is thus believed to contribute to such improved comminution performance.

Mine-to-mill studies have shown that modest increases, of the order of 10-20%, in explosives powder factor can deliver increased milling throughput. It has been proposed that more dramatic increases, of the order of a factor of 2-10, may actually result in explosives energy performing much of the comminution process and lead to much larger increases in mill throughput. The economic impact of even a 10% increase in mill throughput is enormous for many metalliferous or precious metal mines. Additional benefits will flow from reductions in electricity consumption and the associated greenhouse gas emissions, which can also have an economic value attached to them.

Up to now the major constraints on achieving very high explosive energy concentrations in blasts, which are conventionally expressed in terms of powder factors, have been largely around control of the increased energy. Blast designs need to safely contain the explosive energy to avoid flyrock, excessive vibration and noise, and damage to surrounding mine infrastructure, including highwalls or remaining intact rock. In underground mining, rock breakage is sometimes intended to be limited to the zones of ore, for example within stopes, without unduly breaking waste rock around the ore zone. If waste rock is broken into the stope then the ore-to-waste ratio decreases; a deleterious process known as dilution. Also excessive damage to surrounding rock may lead to mine instability. Access tunnels, or drives, also need to be protected from excessive damage.

Increases in explosives energy or powder factor have thus generally been restricted by these factors. Where blast designers have strived to maximize explosive energy within the blast to achieve improved fragmentation, the blast designs have generally been limited to the highest powder factors that avoid flyrock and other damaging environmental incidents.

It would thus be a major advantage in mining if blasting could effect improved fragmentation and fracturing of rock that requires comminution. The present invention provides such an improvement while simultaneously ensuring that deleterious blast environmental effects are safely constrained.

As noted above, blast designers conventionally describe the explosives energy concentration within blasts by the powder factor. Powder factors are typically expressed in terms of the explosive mass per unit of unblasted rock volume or mass. Thus powder factors may be expressed as kilograms of explosive per bank, or solid, cubic meter of unblasted rock (kg/bcm or kg/m$^3$). Powder factors may also be expressed as kilograms per tonne of unblasted rock (kg/t). Rarely, powder factors may be expressed in terms of volume of explosive per unit volume or mass or rock. Other units, such as Imperial units of pounds of explosive per cubic foot of unblasted rock (lb/ft$^3$) or even mixed units such as pounds of explosive per tonne of rock are also used. Occasionally, where the explosives energy content per unit mass is known, blast designers may express powder factors in terms of explosive energy per unit rock volume or mass, such as for example MJ of explosive energy per tonne of unblasted rock (MJ/t rock). It is to be understood that while metric units of explosive mass per unit volume of unblasted rock are used here, all such systems of units may be used interchangeably by simply applying the appropriate unit conversion factors, density or explosive energy content per unit mass.

Conventionally, global blast powder factors describe the total mass of explosive in the blast field divided by the total rock volume or mass in the blast field. However, localized powder factors may also be used to describe powder factors in regions or zones of blasts. In such cases, a zone may be defined by the blast designer as a region within certain geometrical points, lines, planes or surfaces within the blast. Blast limits or perimeters are usually defined by the outermost blastholes or free surfaces or edges. Occasionally, an additional amount of rock may be added to the outermost holes to define the blast field or zones therein. Such an additional amount may constitute a fraction of the burden or spacing of the outermost blastholes. Such limits may also define the perimeters of blast regions or zones. The ends of columns of explosives, or interfaces with inert stemming material, may also conveniently be used as points for defining blast zones or layers. At the level of individual holes, powder factors may be expressed as the explosive content (mass or energy) per unit of rock volume surrounding the hole, that is the rock volume that the specific hole is intended to fracture in the blast. Conventionally thus, the powder factor can also be expressed as the explosive content in the hole (mass or energy) divided by the product of the hole burden, spacing and depth (or the total height of the blast zone). The rock volumes thus calculated may also be converted to rock mass by multiplying by the rock density, where it is desired to express powder factor in terms of explosive mass per unit mass of rock. Where blastholes patterns and explosive loading in the blastholes are regular through the blast field, the global blast powder factor will equal localised or even individual blasthole powder factors.

Powders factors used in common blasting techniques, both in open cut and underground mining for recoverable mineral, are generally of the order of 1 kg/m$^3$ or less for production blasts. Examples, definitions and calculations of powder factors and conventional blasting methods may be found in:

ICI Handbook of Blasting Tables, July 1990;

Orica Explosives Blasting Guide, August 1999, ISBN 0 646 24001 3;

ICI Explosives Safe and Efficient Blasting in Open Cut Mines, 1997; and

Tamrock Handbook of Surface Drilling and Blasting.

Examples of powder factors in a Stratablast® blasting technique of Orica Mining Services, Australia are given in WO 2005/052499.

Occasionally powder factors may be increased to about 1.5 kg/m$^3$, and there have also been reports of the use of powder factors as high as 2.2 kg/m$^3$ in some open cut mines. Such high powder factors have been used rarely in production blasting, for very hard rock, with the hardness of the rock and the adjustment of stemming being used to control flyrock.

In special blasting circumstances in underground mining, powder factors may be higher than this. However these circumstances have been in the construction of shafts, access tunnels or drives, or so-called rises, raises, slots or ore passes to provide conduits for transporting broken ore. These situations comprise blasts in highly confined spaces where dilution of ore is not an issue. By contrast, blasting of ore for recoverable mineral in stopes is conventionally performed at powder factors below 1.5 kg/m$^3$ in order not to excessively damage surrounding intact rock or mine structure or cause excessive dilution of the ore by breaking surrounding waste rock into the ore.

SUMMARY OF THE INVENTION

We have now discovered that it is possible to achieve much higher powder factors, and thereby increased explosive energy concentrations in production blasting, than have conventionally been employed while safely containing the explosives energy. While a major advantage of this is the achievement of improved rock fragmentation, it may also be advantageous in the removal of waste or overburden rock, where increased excavation or mining efficiencies may be achieved by influencing the displacement or final disposition of the rock.

According to a first aspect of the present invention, there is provided in mining for recoverable mineral, a method of blasting rock comprising drilling blastholes in a blast zone, loading the blastholes with explosives and then firing the explosives in the blastholes in a single cycle of drilling, loading and blasting, wherein the blast zone comprises a high energy blast zone in which blastholes are partially loaded with a first explosive to provide a high energy layer of the high energy blast zone having a powder factor of at least 1.75 kg of explosive per cubic meter of unblasted rock in the high energy layer and in which at least some of those blastholes are also loaded with a second explosive to provide a low energy layer of the high energy blast zone between the high energy layer and the adjacent end of those blastholes, said low energy layer having a powder factor that is at least a factor of two lower than the powder factor of said high energy layer.

By the invention, part of the rock mass itself, the lower energy layer, may be used to contain the explosive energy of the high energy layer, enabling the very high powder factors to be used. Thus, in both open cut and underground mining, the low energy layer may provide a protective layer or blanket of rock, which may be unblasted at the time the high energy layer is initiated. In one embodiment, the invention may even be used in a throw blast or in a Stratablast® type of blast in which some blast material is subjected to a throw blast.

For the purposes of this invention, the high energy blast zone is defined as the portion of the blast zone delimited by the outermost blastholes loaded with said first explosive. The high energy layer is delimited by the ends or extremities of the columns of said first explosive and planes joining the common ends (i.e. upper or lower relative to the lengths of the columns) of the columns of first explosive in the blastholes of the high energy blast zone. Correspondingly, the low energy layer of the high energy blast zone is delimited by the high energy layer and planes joining adjacent ends of those blastholes of high energy blast zone loaded with said second explosive and of said outermost blastholes. In open cut mining, the adjacent ends of the blastholes are the collar ends. In underground mining, the adjacent ends of the blastholes may be the toe ends.

In one embodiment, the low energy layer in the high energy blast zone has a powder factor of at most 2.0 kg or at most 1.5 kg of explosive per cubic meter of unblasted rock in the low energy layer. In some embodiments it is at most 1 kg/m$^3$, for example at most 0.5 kg/m$^3$ or even at most 0.25 kg/m$^3$.

Preferably, the low energy layer has a depth or thickness, in the direction perpendicularly away from the high energy layer, of at least 2 m.

The high energy layer of the high energy blast zone may have a powder factor as high as 20 or more kg of explosive per cubic meter of unblasted rock in the high energy layer. In one embodiment, it is at least 2 kg/m$^3$ or even at least 2.5 kg/m$^3$. In another embodiment, it is at least 4 kg/m$^3$, for example at least 6 kg/m$^3$ or even at least 10 kg/m$^3$.

Various ways of achieving the high and low energy layers of a high energy blast zone are possible, whether the first and second explosives are the same or different. Typically, smaller or fewer charges may be loaded into the low energy layer than in the high energy layer. This may include the use of more blastholes in the high energy layer. It may also include not charging some of the blastholes in the low energy layer, or using inert decks of stemming or air in the low energy layer.

Explosives of different density may be used; with higher densities being used in the high energy layer. Furthermore, explosives of varying energy output may be used, with the first explosive having a greater blast energy per unit mass than the second explosive. In particular, explosive of higher shock or fragmentation energy output per unit mass may be used in the high energy layer. The first explosive may also or alternatively have a greater blast velocity of detonation than the second explosive. For example, explosive known as heavy ANFOs may be used in the high energy layer and lower density ANFO (Ammonium Nitrate Fuel Oil) explosive may be used in the low energy layer.

Another means of achieving the high and low energy layers is to use blastholes of different diameter, with larger diameters in the high energy layer. Thus, in one embodiment, at least those blastholes in the high energy zone loaded with both first explosive and second explosive have a first diameter portion loaded with the first explosive and a second diameter portion loaded with the second explosive, and wherein the first diameter is greater than the second diameter. Using appropriate variable diameter drill technology, it would be possible to drill blastholes with a smaller diameter in the low energy layer and a larger diameter in the high energy layer.

The first and second explosives may be fired at the same time. Thus for example, the first and second explosives in any one blasthole may be tired at the same time. However, it is believed to be advantageous to initiate the high and low energy layers in the high energy blast zone sequentially. The sequential blasting may be in any order, but preferably the first explosive in the high energy layer is fired after the second explosive in the low energy layer.

As a general rule in the sequential blasting of the layers, it is preferred that any charge of the explosive to be fired in one of the high and low energy layers is fired at least about 500 ms after firing the nearest charge of the explosive in the other of the high and low energy layers. The nearest charge of the explosive may be in the same blasthole or an adjacent one. Particularly in a large blast, but also where blast vibration is not of undue concern, it may be desirable in accordance with the sequential blasting technique to initiate the blast in the one of the high and low energy layers of the high energy zone while the blast in the other of the high energy layers is still being initiated elsewhere in the high energy blast zone.

In a particular embodiment, a first charge of the explosive to be fired in said one of the high and low energy layers is fired at least about 500 ms after firing the last charge of the explosive in the other of the high and low energy layers.

Thus, in one embodiment, the high energy layer is initiated at least about 500 ms after initiation of the nearest explosive charge to fire in the low energy layer of the high energy blast zone. It may be even more advantageous to initiate the first charge in the high energy layer at least about 500 ms after initiation of the last explosive charge to fire in the low energy layer.

In the sequential blasting of the layers the preferred delay of at least 500 ms between blasting the first layer and blasting the second layer, whether relative to the nearest explosive charge in the first layer or to the last initiation in the first layer, may be at least about 2000 ms. In some cases, this delay may be longer, for example more than 5000 ms. Essentially, such long delays allow for complete fragmentation and cessation of movement of at least most of the rock from the first layer, generally the low energy layer, whether locally or throughout the entire high energy blast zone, prior to initiation of the second layer. This delay may be even longer, provided that the blast is essentially part of a single cycle of drilling and blasting within the mine.

Electronic delay detonators provide the most effective means of initiation for the purposes of this invention. However it is possible to use nonelectric initiation means.

WO 2005/052499 discloses blasting of two or more layers of rock without the use of a high energy layer as described herein, and subject to this difference many of the blasting features described therein may be applied to the present invention. The disclosure of WO 2005/052499 is therefore incorporated herein by reference.

In one embodiment, the blasting according to the invention is in an open cut mine in which the blastholes extend downwardly and the high energy layer is beneath the low energy layer. The blasting of the second explosive in the low energy layer, or the unblasted material in the low energy layer, may result in a blanket of material over the high energy layer.

In this one embodiment, the first explosive in the high energy layer may be offset, for example by up to 2 m or more, from a toe of the blastholes in the high energy blast zone. The portion of those blastholes between the high energy layers and the toe may comprise an inert deck of stemming and/or air. Alternatively, the blastholes may be drilled to a depth that is less, for example by up to 2 m or more than the design depth of the rock breakage zone, commonly referred to as the design bench floor or grade level of the blast.

Alternatively, in a variation, at least some of the blastholes in the high energy blast zone loaded with first explosive are also loaded with further explosive to provide a second low energy layer between the high energy layer and the toes of the blastholes in the high energy blast zone, said second low energy layer having a powder factor that is at least a factor of two lower than the powder factor of the high energy layer. Preferably, this second low energy layer has a powder factor of at most 1.5 kg of explosive per cubic meter of unblasted rock in the second low energy layer.

In an alternative embodiment, the blasting according to the invention is in an underground mine and the first explosive and the second explosive are loaded, respectively, closer to a collar of the blastholes and closer to a toe of the blastholes. The blasting of the second explosive in the low energy layer, or the unblasted material in the low energy layer, may result in a blanket of material between the high energy layer and the surrounding rock.

In this alternative embodiment, the first explosive in the high energy layer may be offset, for example by up to 2 m or more, from a collar of the blastholes in the high energy blast zone. The portion of those blastholes between the high energy layer and the collar may comprise an inert deck of stemming and/or air. Alternatively, in a variation, at least some of the blastholes in the high energy blast zone loaded with first explosive are also loaded with further explosive to provide a second low energy layer between the high energy layer and the collars of the blastholes in the high energy blast zone, said second low energy layer having a powder factor that is at least a factor of two lower than the powder factor of the high energy layer. Preferably, this second low energy layer has a powder factor of at most 1.5 kg of explosive per cubic meter of unblasted rock in the second low energy layer.

The second low energy layers described above may be achieved by methods selected from those described herein for achieving the low energy layer comprising the second explosive.

Buffer zones of lower or conventional powder factors may also be provided at the edges and back of the blasts to limit collateral damage to highwalls, remaining rock structure or adjoining blocks. This arrangement can also provide for reduction of blast vibrations emanating from the blast zone and/or reductions in rock expression from free surfaces. The blasts can also be "drop cuts" or buffered by material from previous blasts, thus with no completely exposed free faces near to the high energy zones.

Thus, in an embodiment, the blast zone has a perimeter, and the high energy blast zone is isolated from the perimeter by a low energy blast zone, comprising blastholes that are drilled, loaded and blasted in said single cycle, said blastholes in the low energy blast zone being loaded with explosives to provide a powder factor that is at least a factor of two lower than the powder factor of the high energy blast zone. The low energy blast zone may extend substantially or entirely around the high energy blast zone.

Preferably, the low energy blast zone has a powder factor of at most 1.5 kg of explosive per cubic meter of unblasted rock in the low energy blast zone.

Advantageously, the explosives in the high energy blast zone are fired after the explosives in the low energy blast zone have been fired. The delays between firing the low and high energy blast zones may be, for example, as described above for the delay between low and high energy layers in the high energy blast zone.

The low energy blast zone can be achieved using any of the methods described above for achieving the low energy layer of the high energy blast zone.

A particular embodiment of the invention is to provide the high energy blast zone in a region of ore containing economic concentrations of recoverable mineral, for example metalliferous minerals, and to provide the low energy blast zone in a region of waste rock.

BRIEF DESCRIPTION OF PREFERRED EMBODIMENTS

Various embodiments and methods for achieving the invention are described in the Examples that follow, which are given for purposes of illustration only and should not be considered as limiting the scope of the invention.

The Examples refer to drawings, in which:

FIG. 1 shows a cross section of a conventional open cut blast in accordance with Example 1a, and the resulting maximum rockpile displacement, with contours of velocity shown as shades, as modelled by an advanced blasting model named SoH. This model is described in: Minchinton, A. and Lynch, P., 1996, Fragmentation and heave modelling using a coupled discrete element gas flow code, *Proc. 5th International Symposium on Rock Fragmentation by Blasting-Fragblast* 5 (Ed: B Mohanty), pp 71-80, (Balkema: Rotterdam); and Minchinton, A. and Dare-Bryan, P., 2005, On the application of computer modelling for blasting and flow in sublevel caving operations, *Proc. 9th Underground Operators' Conference,* Perth, Wash. 7-9 Mar. 2005 (AusIMM).

FIG. 5 is a view similar to FIG. 3, but of a conventional open cut blast in accordance with Example 4a;

Figure 1:
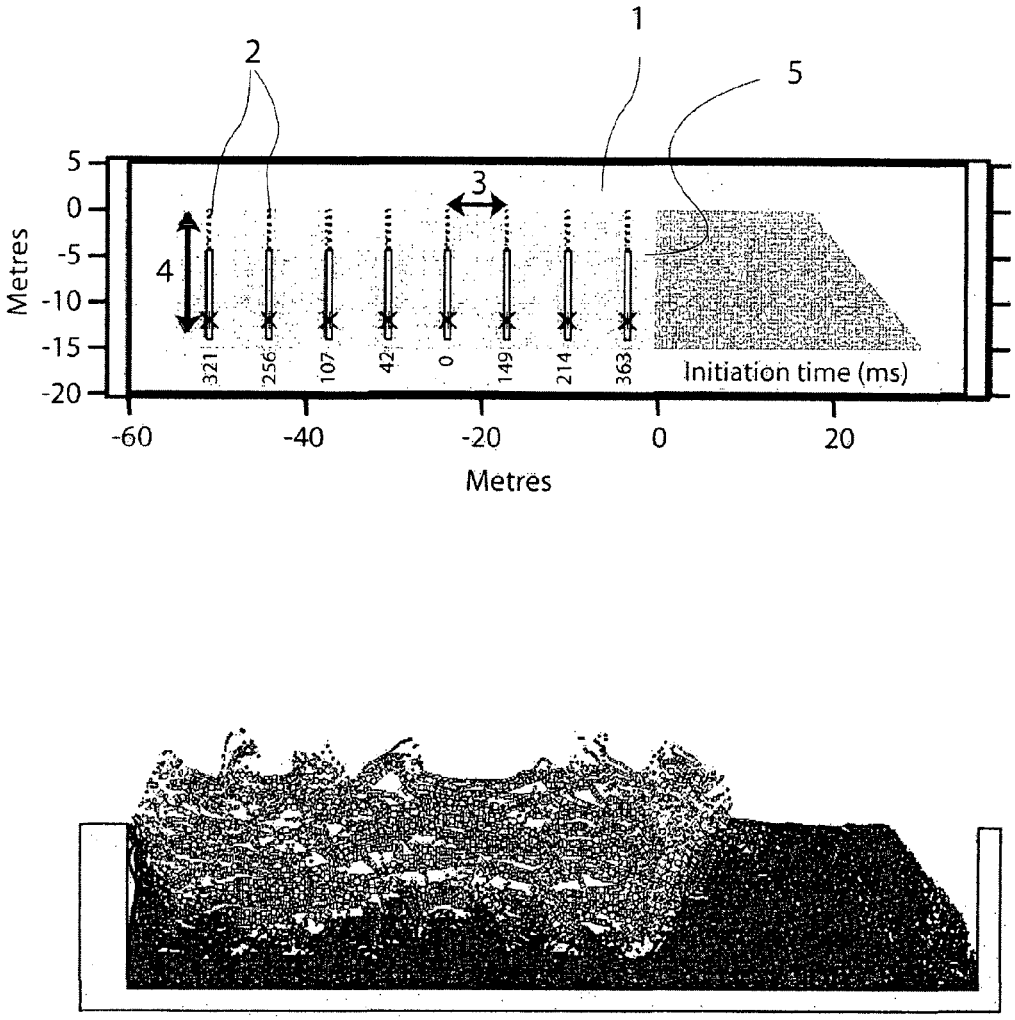

In Examples 1 to 7 the rock type is classified as a hard metalliferous ore-bearing rock with an unconfined compressive strength in excess of 150 MPa. Except where otherwise specified, the explosive is a heavy ANFO type at a density of around 1300 kg/m$^3$. Inert material, typically rock aggregate or sometimes drill cuttings, is used as stemming. All holes are stemmed from the uppermost ends of the uppermost explosive columns to the uppermost ends or collars of the blastholes, which are at the blast surface. The blast zone is located within an area of ore containing recoverable metal. After blasting, the ore is loaded into trucks using a rope shovel excavator and processed in a comminution circuit comprising a primary crusher, semi-autogenous (SAG) mill and ball mills to produce ore particles of less than 75 microns for the downstream minerals processing operations. In blasts according to the invention, the use of higher concentrations of explosives energy leads to an improved fragmentation and increased productivity of the load and haul and comminution mining processes.

In Examples 1 to 4 a blast zone of bench height 12 m in an open cut mining operation is drilled with 229 mm diameter holes.

In all examples, including Examples 5 to 11, the blast zone is drilled, loaded with explosives and fired within a single cycle of drilling, loading and blasting.

In Example 5, blasting according to the invention utilises blasthole lengths of greater diameter for a high energy layer, as described in the Example, but otherwise the blast is as generally described above.

In Examples 6 and 7, blasting according to the invention is underground and the blastholes extend generally upwardly away from an access tunnel, as described in these Examples, but otherwise the blast is as generally described above. Blastholes may also extend generally downwardly away from an access tunnel and the blasts in such blastholes would be as generally described in Example 6 except for this difference.

In Examples 8-10, the blast is in an open cut coal mine, where the overburden rock to be blasted has an average unconfined compressive strength of about 40 MPa. In these Examples, the invention provides for improved throw of the overburden into a final spoil position as well as enhanced fragmentation for increased mine machine productivity.

For convenience, the same reference numerals are used in all of the Examples.

Example 1

Use of Conventional Blast Methods in Open Cut Mining

This example illustrates generally conventional blasting practice and demonstrates that high powder factors using such conventional methods are not safe and hence not viable for mining operations for recoverable mineral.

Example 1a

The first base case conventional blast reflects standard practice using a conventional powder factor of about 0.8 kg/m$^3$ of unblasted rock. Referring to the cross section of the blast zone (1) shown in FIG. 1, which illustrates the vertical and horizontal depth of the blast in meters, the blast comprises eight rows (2) of thirty blastholes per row each with a nominal diameter of 229 mm. The average or nominal burdens (3) and spacings (out of the plane of FIG. 1) are 6.8 m and 7.8 m respectively. The total blasthole depths (4) are around 14 m, using 2 m of subdrill below the design bench floor depth of 12 m from the surface. All holes are loaded with a 9.4 m column of explosive thus resulting in a powder factor of about 0.8 kg explosive/m$^3$ of unblasted rock. A body of buffer material comprising previously blasted rock is shown in a darker shade of grey, extending from the face of the blast (at 0 m). Also shown in the top part of FIG. 1 are the nominal initiation (inter-row delay) times of the holes in milliseconds at the detonators X, with an inter-hole delay along rows (not shown, out of the plane of the Figure) of 65 ms being used. Calculated on a per hole basis, the powder factor is determined as follows:

Explosive mass per hole=9.4 m of explosive×53.54 kg/m in a 229 mm hole=503 kg

Unblasted rock volume per hole=6.8 m burden×7.8 m spacing×12 m bench height=636 $m^3$ of unblasted rock Powder factor=explosive mass per hole/unblasted rock volume per hole=503 kg explosive/636 $m^3$ of unblasted rock=0.79 kg explosive/$m^3$ of unblasted rock.

It is seen from the representation of the resulting vertical maximum rockpile displacement at the bottom of FIG. 1 that conventional practice using a conventional powder factor yields a conventional rockpile with a safe maximum displacement of the rock of about 9.5 m, hence no flyrock.

Example 1b

The second base case conventional blast reflects standard practice but using a very high powder factor of close to 4 kg/$m^3$ of unblasted rock. Referring to the cross section of the blast field (1) shown in FIG. 2, which illustrates the vertical and horizontal depth of the blast in meters, this blast comprises fifteen rows (2) of thirty blastholes pet row each with a nominal diameter of 229 mm. Within this blast is a high energy zone comprising rows 1-13 (rows numbered from right to left in FIG. 2). The average or nominal burdens (3) and spacings (out of plane of the Figure) in this zone are 3.1 m and 3.1 m respectively.

Figure 2:
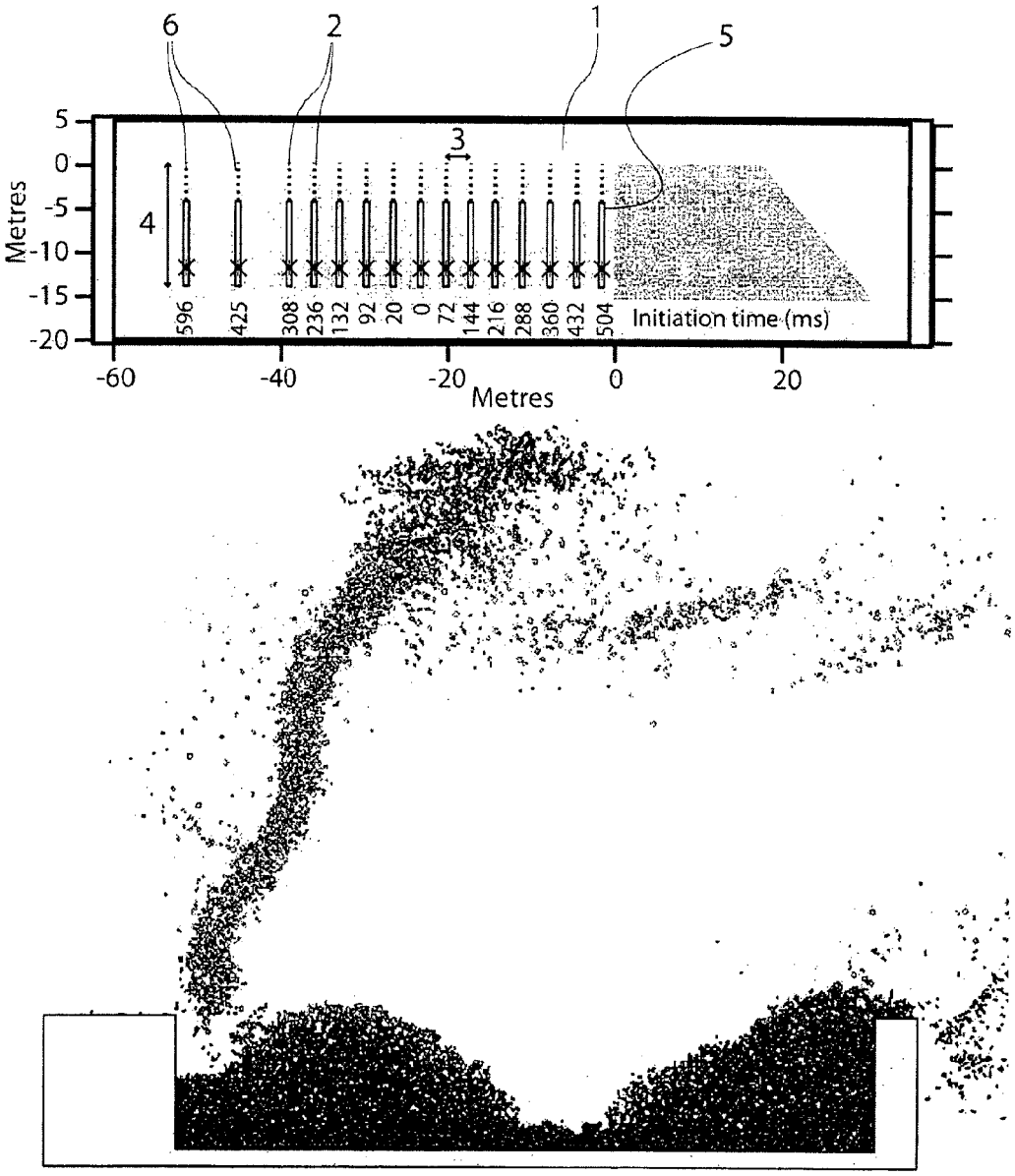
FIG. 2 shows a cross section of another conventional, but rarely used, open cut blast in accordance with Example 1b, and the resulting maximum rockpile displacement, as modelled by the advanced blasting model SoH.

The total blasthole depths (4) are around 13 m, using 1 m of subdrill below the design bench depth of 12 m from the surface. All holes are loaded with a 8.4 m column of explosive (5) thus resulting in a powder factor of about 4 kg explosive/$m^3$ of unblasted rock. A body of buffer material comprising previously blasted rock is shown in a darker shade of grey, extending from the face of the blast (at 0 m). Also shown in the top part of FIG. 2 are the nominal initiation (inter-row delay) times of the holes in, milliseconds at the detonators X, with an inter-hole delay along rows (not shown, out of the plane of the Figure) of 65 ms being used. Rows 14-15 (6) at the back of the blast are on a larger average or nominal burden and spacing leading to a lower powder factor in this buffer zone against the new highwall.

Calculated on a per hole basis, the powder factor in the high energy zone is determined as follows:

Explosive mass per hole=8.4 m of explosive×53.54 kg/m in a 229 mm hole=450 kg

Unblasted rock volume per hole=3.1 m burden×3.1 m spacing×12 m bench height=115 $m^3$ of unblasted rock Powder factor=explosive mass per hole/unblasted rock volume per hole=450 kg explosive/115 $m^3$ of unblasted rock=3.91 kg explosive/$m^3$ of unblasted rock.

It is seen from the representation of the resulting maximum vertical rockpile displacement at the bottom of FIG. 2 that conventional practice using a high powder factor results in a completely uncontrolled blast with excessive flyrock, reaching a height of about 70 m. This demonstrates that conventional blasting methods cannot be safely employed with high powder factors.

Example 2

This example demonstrates an embodiment of the invention. Referring to the cross section of the blast zone (1) shown in FIG. 3, which illustrates the vertical and horizontal depth of the blast in meters, this blast comprises fifteen rows (2) of thirty blastholes per row each with a nominal diameter of 229 mm. Within this blast is a high energy zone comprising rows 1-13 (rows numbered from right to left in FIG. 3). The average or nominal burdens (3) and spacings (out of the plane of the Figure) in this zone are 3.1 m and 3.1 m respectively. The total blasthole depths (4) are around 13 m, using 1 m of subdrill below the design bench depth of 12 m from the surface. All holes are loaded with a 6 m column of first explosive (5) at a density of 1300 kg/$m^3$ thus resulting in a powder factor of about 6.7 kg explosive/$m^3$ of unblasted rock in a high energy layer. Every second row, and every second hole along these rows, is also loaded with a 2.5 m column of second explosive (6) at a density of 1200 kg/$m^3$ above the first explosive, thus providing a low energy layer with a powder factor of 0.55 kg explosive/$m^3$ of unblasted rock above the high energy layer. Here, the low energy layer extends from the uppermost ends of the columns of the first explosive (5) to the uppermost ends or collars of the blastholes, which are at the blast surface. Thus the high energy layer extends for 6 m from the toe of the blastholes while the low energy layer extends from the top of the high energy layer to the blast surface, a thickness of 7 m. A body of buffer material comprising previously blasted rock is shown in a darker shade of grey, extending from the face of the blast (at 0 m).

Figure 3:
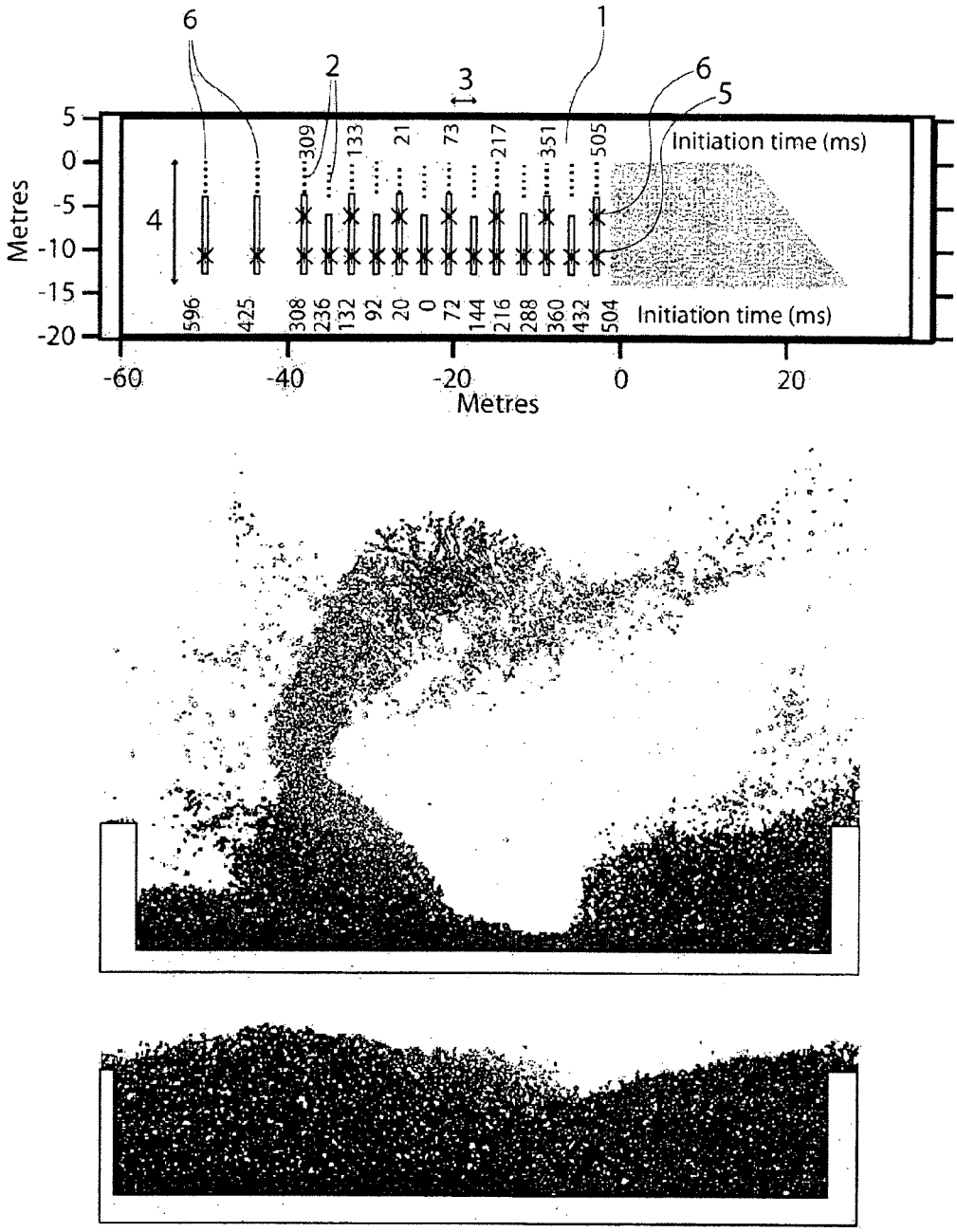
FIG. 3 shows a cross-section of an embodiment of an open cut blast in accordance with Example 2 of the invention, and the resulting maximum rockpile displacement as well as the final rockpile displacement.

Also shown in the top part of FIG. 3 are the nominal initiation (inter-row delay) times of the holes in milliseconds at the detonators X, with an inter-hole delay along rows (not shown, out of the plane of the Figure) of 65 ms being used. Rows 14-15 (6) at the back of the blast are on a larger average or nominal burden and spacing leading to a lower powder factor in this low energy or buffer zone of the blast adjacent to the new highwall. The blast is initiated using electronic detonators indicated with a cross in the Figure. FIG. 3 also shows, towards the bottom, the modelled outcome of this design, showing the maximum vertical displacement of about 40 m as well as the final rockpile profile at the bottom, which falls largely in the original blast zone. It is seen that improved control is obtained over the conventional blasting methods shown in Example 1, despite a powder factor of in excess of 6.6 kg/$m^3$ being used in the high energy layer.

Example 3

In this example even more control is achieved in the blast, using another embodiment of the invention. Referring to the cross section of the blast zone (1) shown in FIG. 4, which illustrates the vertical and horizontal depth of the blast in meters, this blast comprises twelve rows (2) of thirty blastholes per row each with a nominal diameter of 229 mm. Within this blast is a high energy zone comprising rows 1-10 (rows numbered from right to left in FIG. 4). The burdens (3) and spacings (out of the plane of the Figure) in this zone are 3.1 m and 3.1 m respectively. The total blasthole depths (4) are around 13 m, using 1 m of subdrill below the design bench depth of 12 m from the surface. Blastholes in rows 1, 3, 5, 7 and 9 are loaded with a 5 m column of first explosive (5) at a density of 1300 kg/$m^3$. Every second hole in these rows is also loaded with a 2.5 m column of inert stemming material (7) above the column of first explosive and then a 2.5 m column of a second explosive (6) at a density of 1200 kg/m$^3$. Holes in rows 2,4,6,8 and 10 are loaded with a 6 m column of first explosive (5) at a density of 1300 kg/m$^3$. All blastholes are stemmed from the tops of the uppermost explosive columns to the surface with inert stemming material.

This loading provides for a powder factor of about 6.8 kg explosive per m$^3$ of unblasted rock in the high energy layer, which extends from the base or design floor level of the blast zone to the tops of the columns of first explosive at either 5 m or 6 m from the toes of the blastholes. It also provides for a powder factor of about 0.43 kg explosive per m$^3$ of unblasted rock in the low energy layer, which extends from the tops of the columns of first explosive at either 5 m or 6 m from the toes of the blastholes to the upper collar ends of the blastholes at the surface of the blast. A body of buffer material comprising previously blasted rock is shown in a darker shade of grey, extending from the face of the blast (at 0 m).

Figure 4:
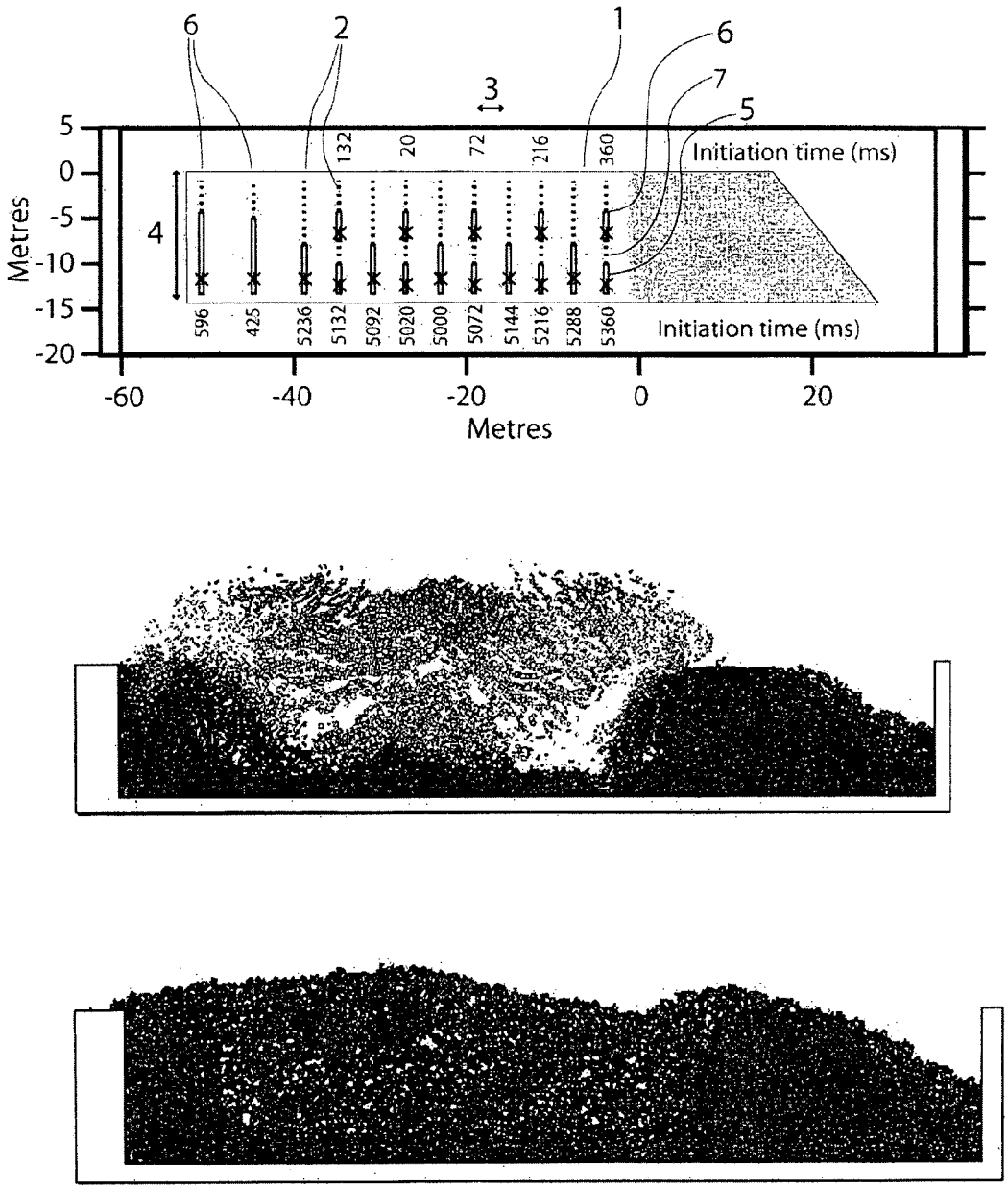
FIG. 4 is a view similar to FIG. 3, but of another embodiment of an open cut blast in accordance with Example 3 of the invention.

Also shown in the top part of FIG. 4 are the nominal initiation (inter-row delay) times of the holes in milliseconds in both layers at the detonators X, with an inter-hole delay along rows in both layers (not shown, out of the plane of the Figure) of 65 ms being used. The first explosive in the high energy layer is initiated after a delay of 5000 ms after the nearest explosive in the low energy layer. This delay provides for a layer or blanket of broken rock to be formed and come to rest in the low energy layer, covering the high energy layer when it initiates; thereby controlling flyrock and allowing the rock to be highly fragmented while remaining essentially within the original blast zone.

Rows 11-12 (6) at the back of the blast are on a larger average or nominal burden and spacing leading to a lower powder factor in this low energy or buffer zone, providing protection to the endwalls of the blast and remaining rock structure. The blast is initiated using electronic detonators indicated with a cross in the Figure. FIG. 4 also shows, towards the bottom, the modelled outcome of this design, showing the maximum vertical displacement of only about 10 m as well as the final rockpile profile at the bottom. It is seen that excellent control is obtained using this embodiment of the invention, providing for a powder factor of in excess of 6.5 kg/m$^3$ in the high energy layer of the high energy zone.

Example 4

This example shows a blast initiated at one corner, both for a base case conventional blast reflecting standard practice but using a very high powder factor and for an embodiment of the invention showing how control of the blast is achieved with such a high powder factor.

Example 4a

Figure 5:
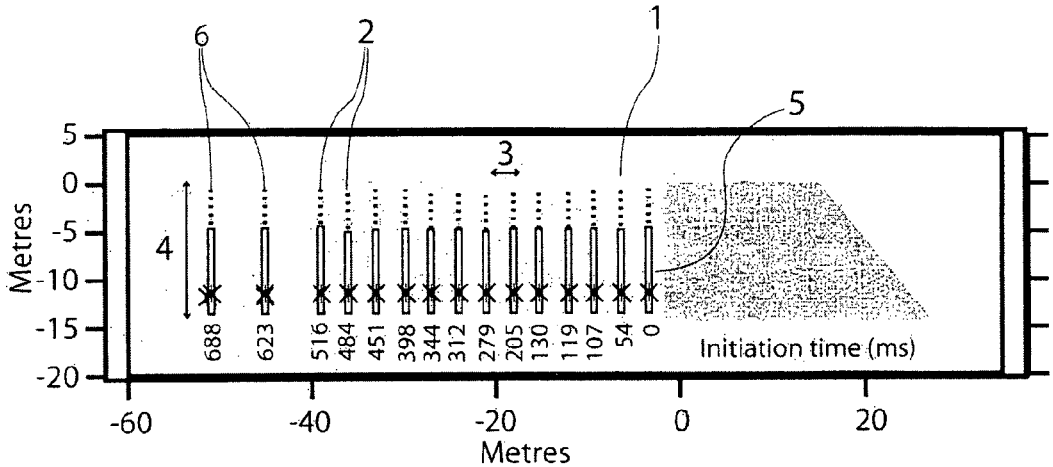
Figure 5:
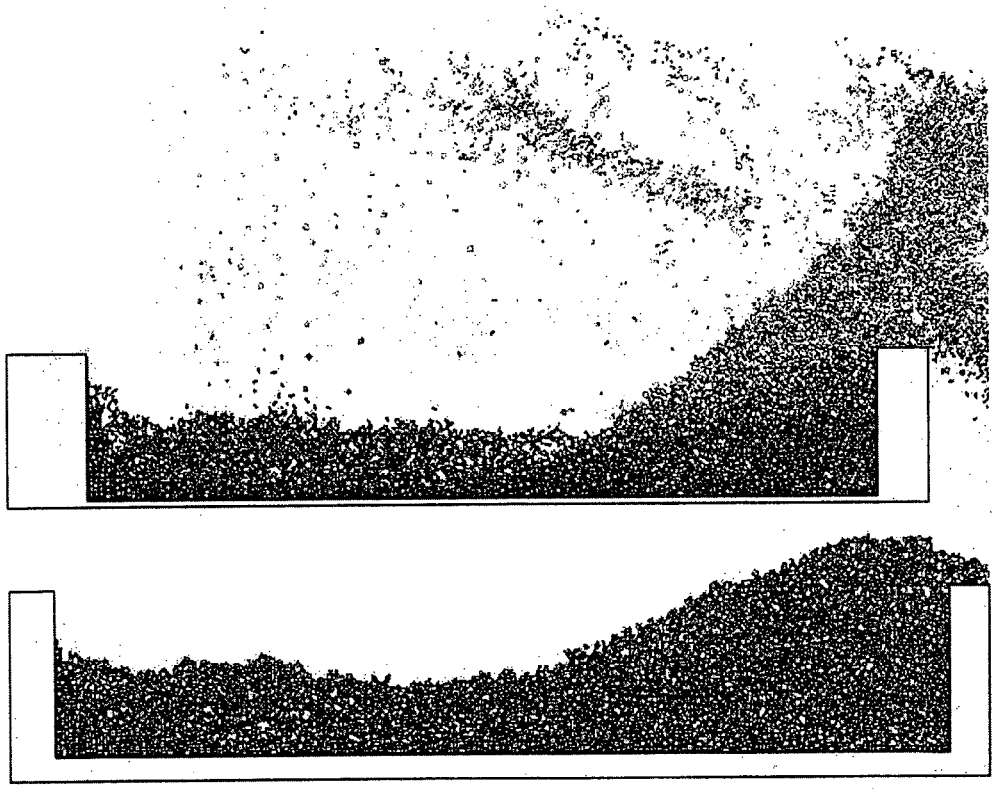

Referring to the cross section of the blast field (1) shown in FIG. 5, which illustrates the vertical and horizontal depth of the blast in meters, this blast comprises fifteen rows (2) of thirty blastholes per row each with a nominal diameter of 229 mm. Within this blast is a high energy zone comprising rows 1-13 (rows numbered from right to left in FIG. 2. The average or nominal burdens (3) and spacings (out of the plane of the Figure) in this zone are 3.1 m and 3.1 m respectively. The total blasthole depths (4) are around 13 m, using 1 m of subdrill below the design bench depth of 12 m from the surface. All holes are loaded with a 8.4 m column of explosive (5) of density 1350 kg/ml thus resulting in a powder factor of about 4 kg explosive/m$^3$ of unblasted rock. Also shown in the top part of FIG. 5 are the nominal initiation (inter-row delay) times of the holes in milliseconds at the detonators X, with an inter-hole delay along rows (not shown, out of the plane of the Figure) of 65 ms being used. Rows 14-15 (6) at the back of the blast are on larger average or nominal burden and spacing leading to a lower powder factor in this low energy or buffer zone adjacent to the new highwall. A body of buffer material comprising previously blasted rock is shown in a darker shade of grey, extending from the face of the blast (at 0 m).

The blast is initiated from one corner at the back of the blast zone.

Calculated on a per hole basis, the powder factor in the high energy zone is determined as follows:

Explosive mass per hole=8.4 m of explosive×55.54 kg/m in a 229 mm hole=466 kg

Unblasted rock volume per hole=3.1 m burden×3.1 m spacing×12 m bench height 115 m$^3$ of unblasted rock Powder factor=explosive mass per hole/unblasted rock volume per hole=466 kg explosive/115 m$^3$ of unblasted rock=4.05 kg explosive/m$^3$ of unblasted rock.

FIG. 5 also shows, towards the bottom, the resulting maximum rockpile displacement and final rockpile profile (at the bottom of the Figure) as modelled by the advanced blasting model SoH. It is seen that conventional practice using a high powder factor results in a completely uncontrolled blast with excessive flyrock, reaching a height of about 35 m, with much of the final rockpile falling outside the original blast field. This again demonstrates that conventional blasting methods cannot be safely employed with high powder factors.

Example 4b

Figure 6:
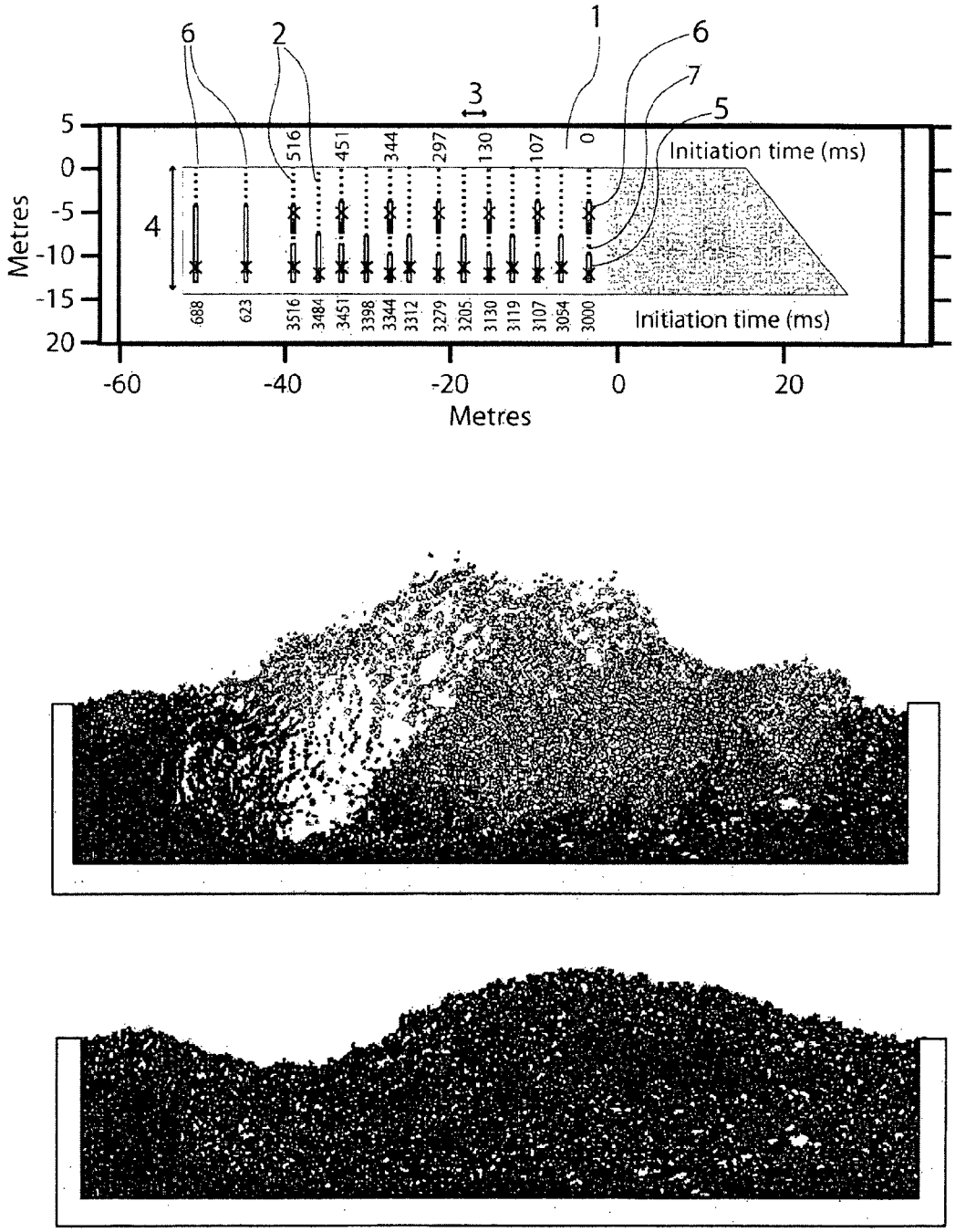
FIG. 6 is a view similar to FIG. 5 of a blast similar to that in Example 4a but modified to be an embodiment of an open cut blast in accordance with Example 4b of the invention.

Using an embodiment of the invention, FIG. 6, which illustrates the vertical and horizontal depth of the blast in meters, shows a blast comprising fifteen rows (2) of thirty blastholes per row each with a nominal diameter of 229 mm. Within this blast is a high energy zone comprising rows 1-13 (rows numbered from right to left in FIG. 6). The average or nominal burdens (3) and spacings (out of the plane of the Figure) in this zone are 3.1 m and 3.1 m respectively. The total blasthole depths (4) are around 13 m, using 1 m of subdrill below the design bench depth of 12 m from the surface. Holes in rows 1, 3, 5, 7 and 9 are loaded with a 5 m column of first explosive (5) at a density of 1300 kg/m$^3$.

Every second hole in these rows is also loaded with a 2.5 m column of inert stemming material (7) above the column of first explosive and then a 2.5 m column of a second explosive (6) at a density of 1300 kg/m$^3$. This second explosive is the same type and density of explosive as the first explosive, namely a heavy ANFO formulation. Holes in rows 2, 4, 6, 8 and 10 are loaded with a 6 m column of first explosive (5) at a density of 1300 kg/m$^3$. All blastholes are stemmed from tops of the uppermost explosive columns to the surface with inert stemming material.

This loading provides for a powder factor of about 6.8 kg explosive per m$^3$ of unblasted rock in the high energy layer, which extends from the base or design floor of the blast field to the tops of the columns of first explosive at either 5 m or 6 m from the toes of the blastholes. It also provides for a powder factor of about 0.6 kg explosive per m$^3$ of unblasted rock in the low energy layer, which extends from the tops of the columns of first explosive at either 5 m or 6 m from the toes of the blastholes to the upper collar ends of the blastholes at the surface of the blast.

Also shown in the top part of FIG. 6 are the nominal initiation (inter-row delay) times of the holes in milliseconds at the detonators X, with an inter-hole delay along rows (not shown, out of the plane of the Figure) of 65 ms being used. Rows 11-12 (6) at the back of the blast are on a larger average or nominal burden and spacing leading to a lower powder factor in this low energy or buffer zone, providing protection to the endwalls of the blast and remaining rock structure. A body of buffer material comprising previously blasted rock is shown in a darker shade of grey, extending from the face of the blast (at 0 m).

This blast is also initiated from one corner as for the base case. In this example the blast is initiated using electronic detonators in each deck of explosive, indicated with a cross in the figure, providing the inter-hole and inter-row delays as specified. However, the decks in the high energy layer are initiated after a delay of 3000 ms after the nearest deck in the low energy layer has initiated. In this case the nearest decks in the low energy layer to the decks in the high energy layer are either the decks that are present within the same blastholes or, where such decks are absent, the decks within adjacent blastholes. FIG. 6 also illustrates, towards the bottom, the modelled outcome of this design, showing the maximum vertical displacement of about 12 m, as well as the final rockpile profile at the bottom of the Figure. It is seen that excellent control is obtained using this embodiment of the invention, providing for a powder factor of in excess of 6.3 kg/bcm in the high energy layer of the high energy zone.

Example 5

Figure 7:
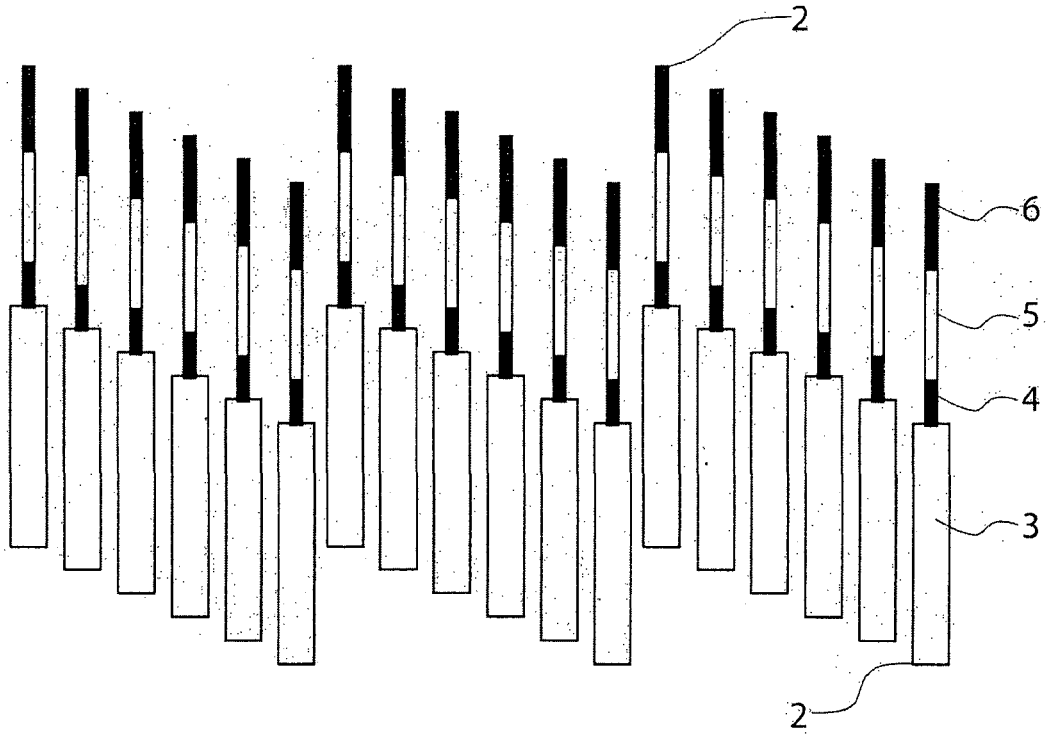
FIG. 7 is a schematic illustration of an embodiment of an open cut blast in accordance with Example 5 of the invention.

This example shows another embodiment of the invention, using multiple hole diameters to achieve the high and low energy layers in a high energy blast zone. Referring to the schematic FIG. 7, a conventional staggered blasthole pattern is drilled in a 16 m bench in a blast zone but with a high energy lower layer having a depth of 9 m being drilled at a hole diameter of 311 mm (1) and a low energy upper layer having a depth of 8 m being drilled at a hole diameter of 165 mm (2). The large diameter high energy layer is loaded with 9 m decks of a first explosive (3) at a density of 1200 kg/m$^3$. A 2.5 m column of inert stemming material (4) is then loaded followed by a 3 m column of a second explosive (5) at a density of 1000 kg/m$^3$. All blastholes are finally stemmed with a 2.5 m column of inert stemming material (6) which extends to the blast surface.

The blast zone has a spacing between rows of 5 m and a burden between holes of 4.5 m.

This loading provides for a powder factor of about 4.05 kg explosive per m$^3$ of unblasted rock in the high energy layer, which extends from the design floor of the blast zone to the tops of the columns of first explosive at 9 m from the toes of the blastholes. It also provides for a powder factor of about 0.35 kg explosive per m$^3$ of unblasted rock in the low energy layer, which extends from the tops of the columns of first explosive at 9 m from the toes of the blastholes to the upper collar ends of the blastholes at the surface of the blast.

In this example the blast is initiated using electronic detonators (not shown) in each deck of explosive, providing a 25 ms inter-hole delay and a 42 ms inter-row delay for both layers. However the decks in the high energy layer are initiated 7000 ms after the nearest deck in the low energy layer has initiated. In this case the nearest decks in the low energy layer to the decks in the high energy layer are the decks within the same blastholes; namely those decks in the low diameter portion of each blasthole. The blast is initiated from one corner.

Example 6

This example shows an embodiment of the invention in an underground mining situation. Referring to the sectional schematic FIG. 8, several so-called fan-shaped rings of blastholes (2) of diameter 165 mm are drilled in a blast zone (1) in an underground stope (only one such ring is shown in the Figure). The blastholes are between 20 m and 30 m long and drilled from the roof of an access tunnel or drive (3) upwards, with the toes being at the uppermost ends of the holes and the collars at the roof of the drive. The Figure only shows one ring, with other rings spaced along the drive (3) on an inter-ring spacing of 3.5 m. The inter-hole spacing within each ring varies according to the geometry.

The holes are loaded at or near the toes with 2 m columns of a second explosive (5) of density 850 kg/m$^3$. In holes 2-6 of each ring, with holes numbered from right to left in FIG. 8, a 3 m column of inert stemming material (6) is then loaded, followed by columns of 5-15 m lengths of a first explosive (4) of density 1200 kg/m$^3$. The collar ends of the holes are left uncharged. The holes at the outer edges of each ring, namely holes 1 and 7 are only loaded with the second explosive (5) at a density 850 kg/m$^3$, thus providing a buffer or low energy zone of lower powder typically below 1 kg of explosive/m$^3$ of unblasted rock around these holes, to protect the remaining intact rock at the edges of each ring.

Figure 8:
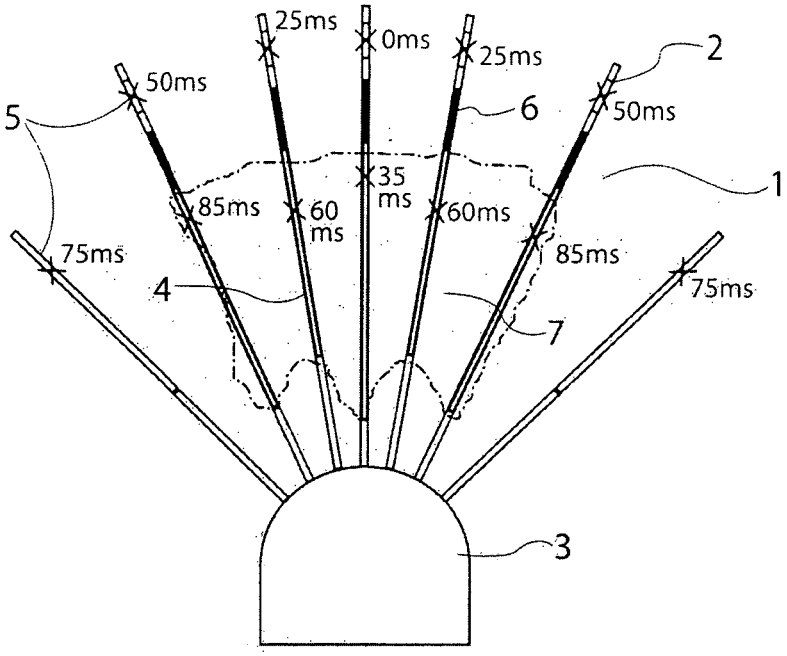
FIG. 8 shows a cross section of an underground blast in accordance with Example 6 of the invention.

This loading arrangement provides a high energy blast zone in several rings by providing a high energy layer of first explosive in holes 2-6 of each ring. The high energy layer (7) is shown in FIG. 8 as the area enclosed by the dashed line. This layer extends along the drive over several such rings. The powder factor within this high energy layer varies according to the blasthole geometry, as a result of the diverging blastholes in the fan-shaped rings, but is at least 1.75 kg/m$^3$ and may be at least 2.5 kg/m$^3$ of unblasted rock in this layer.

Rings at both ends of the blast; namely the first and final rings of the blast along the drive, may not be loaded in this fashion. Instead, these rings may be loaded conventionally with lower powder factors in the same fashion as the buffer holes 1 and 7 of each ring; typically a powder factor of below 1 kg of explosive/m$^3$ of unblasted rock is used in these rings. These first and last rings thus provide another buffer zone to protect remaining intact rock at either end of the blast.

The area outside the high energy layer is thus a low energy or buffer zone and the powder factor in this zone is no more than 1 kg/m$^3$ of unblasted rock in this zone.

All explosive decks are initiated by electronic delay detonators X. The decks in the low energy layer of the blast as well as the buffer holes 1 and 6 of each ring and the holes in the first and final rings of the blast are initiated first with an inter-hole delay in each ring of 25 ms. The decks may be initiated either from hole 1 or hole 7 or from a central hole such as hole 3, 4 or 5. The decks in the high energy layer are initiated after a delay of 35 ms after the explosive deck within the same blasthole of the low energy layer has fired. The delays between successive rings, known as the inter-row or inter-ring delay, is 100 ms.

This provides for a zone of low energy at the outer edges of the blast providing protection to the remaining rock structure from the effects of the high energy layer in the interior of the blast. Much of the ore is thus subjected to the high energy blast layer, producing more intense rock fragmentation in the high energy layer and leading to improved mine productivity.

It will be understood by those skilled in the an that the blast may have any number of rings and blastholes within rings. Furthermore, the buffer zones at the outermost edges of each ring may comprise more than one hole at each edge. More than one ring may also comprise the buffer zones at each end of the blast along the drive.

Example 7

This example shows another embodiment of the invention in an underground mining situation. Referring to the sectional schematic FIG. 9, several so-called fan-shaped rings of blastholes (2) of diameter 165 mm are drilled in a blast zone (1) in an underground stope (only one such ring is shown in the Figure). The blastholes are between 20 m and 30 m long and drilled from the roof of an access tunnel or drive (3) upwards, with the toes being at the uppermost ends of the holes and the collars at the roof of the drive. The Figure only shows one ring, with other rings spaced along the drive (3) on an inter-ring spacing of 3.5 m. The inter-hole spacing within each ring varies according to the geometry.

The holes are loaded at or near the toes with 2 m columns of a second explosive (5) of density 850 kg/m$^3$. In holes 2-6 of each ring, with holes numbered from right to left in FIG. 9, a 3 m column of inert stemming material (6) is then loaded, followed by columns of 5-15 m lengths of a first explosive (4) of density 1200 kg/m$^3$. The collar ends of the holes are left uncharged. The holes at the outer edges of each ring, namely holes 1 and 7 are only loaded with the second explosive (5) at a density 850 kg/m$^3$, thus providing a buffer zone of lower powder factor, typically below 1 kg of explosive/m$^3$ of unblasted rock in these holes, to protect the remaining intact rock at the edges of each ring.

Figure 9:
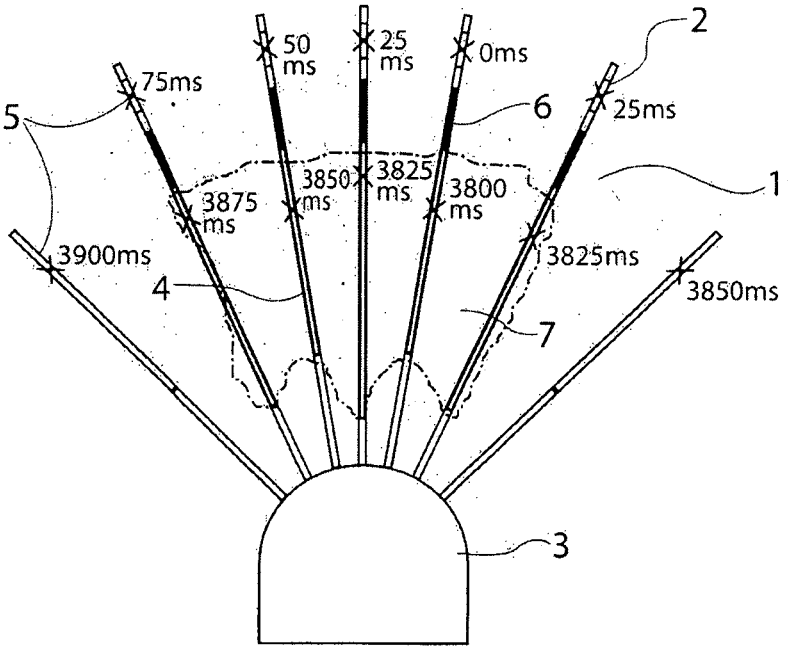
FIG. 9 is a view similar to that of FIG. 8 of a cross section of an underground blast showing another embodiment of the invention in accordance with Example 7 of the invention.

This loading arrangement provides a high energy blast zone in several rings by providing a high energy layer of first explosives in holes 2-6 of each ring. The high energy layer (7) is shown in FIG. 9 as the area enclosed by the dashed line. This layer extends along the drive over several such rings. The powder factor within this high energy layer varies according to the blasthole geometry, as a result of the diverging blastholes in the fan-shaped rings, but is at least 1.75 kg/m$^3$ and may be at least 2.5 kg/m$^3$ of unblasted rock in this layer. Rings at the ends of the blast; namely the first and final rings of the blast, may not be loaded in this fashion. Instead, these rings may be loaded conventionally with lower powder factors in the same fashion as the buffer holes 1 and 7 of each ring; typically a powder factor of below 1 kg of explosive/m$^3$ of unblasted rock is used in these rings. These first and last rings thus provide another buffer zone to protect remaining intact rock at either end of the blast.

The area outside the high energy layer is thus a low energy zone and the powder factor in this zone is no more than 1 kg/m$^3$ of unblasted rock in this zone. The area between the toe ends of the blastholes 2 to 6 and the high energy layer (7) forms a low energy layer of the high energy blast zone. This low energy layer extends from the top of the high energy layer to the upper edges of the blast, a thickness in excess of 2 m. The area between the ends of the explosive columns nearest to the blasthole collars and the roof of the drive provides yet another low energy layer, in this case with no explosive loading in this zone.

All explosive decks are initiated by electronic delay detonators X. The decks in the low energy layer of the blast as well as the buffer holes 1 and 7 of each ring are initiated first with an inter-hole delay in each ring of 25 ms. The decks may be initiated either from hole 1 or hole 7 or from a central hole such as hole 3, 4 or 5. In this example, the decks in the high energy layer are initiated after a delay of 3800 ms after the explosive deck within the same blasthole of the low energy layer has fired. The delays between successive rings, known as the inter-row or inter-ring delay, is 100 ms. It is also possible to instead initiate the buffer holes 1 and 7 on an inter-hole delay of several milliseconds, for example 25 ms, from the initiation time of the nearest deck in the high energy layer. Similarly, the first and final rings of the blast that provide a buffer zone of powder factor typically below 1 kg/m$^3$ of unblasted rock in this zone, may be initiated on the inter-ring delay of typically tens of milliseconds, for example 100 ms, either from the initiation time of the nearest deck in the low or high energy layer.

This provides for a zone of broken rock at the outer edges of the blast field to be formed first, providing protection to the remaining rock structure when the high energy layer is fired several seconds thereafter. Much of the ore is thus subjected to the high energy blast layer, producing more intense rock fragmentation in the high energy layer and leading to improved mine productivity.

The blast may have any number of rings and blastholes within rings. Furthermore, the buffer zones at the outermost edges of each ring may comprise several holes at each edge. Multiple rings may also comprise the buffer zones at each end of the blast along the drive.

Example 8

Figure 10:
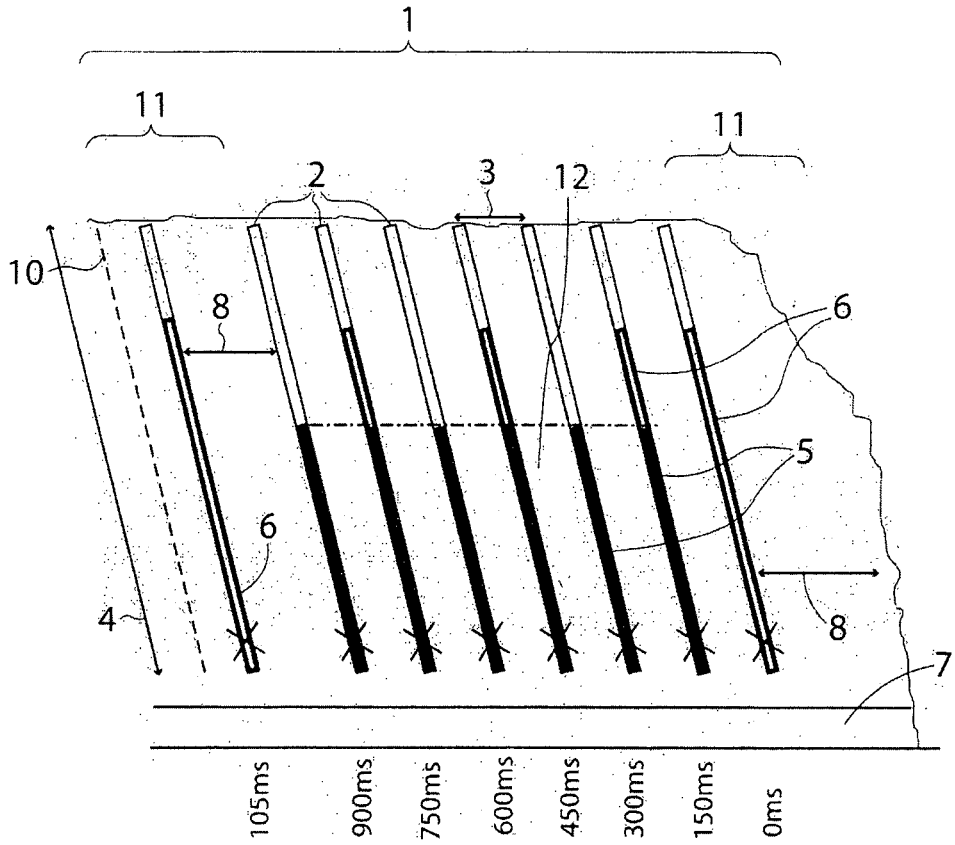
FIG. 10 shows a cross section of an open cut throw blast in accordance with Example 8 of the invention.

This example demonstrates yet another embodiment of the invention, in this case to provide for more favourable displacement of rock as well as improved fragmentation in an open cut throw blasting situation in a coal mine. Referring to the cross section of the blast zone (1) comprising overburden or waste rock over a lower recoverable coal seam (7) shown in FIG. 10, this blast comprises eight rows (2) of forty blastholes per row in rows 1 and 8 and eighty blastholes per row in rows 2-7 (rows numbered from right to left in FIG. 10). Each blasthole has a nominal diameter of 270 mm. The holes are inclined from the vertical at an angle of 10 degrees. Within this blast is a high energy zone comprising rows 2-7. The average or nominal burdens (3) and spacings (out of the plane of the Figure) in this high energy zone are both 5 m. The total blasthole lengths (4) are around 40 m and are drilled only to within 2.5 m of the top of the recoverable coal seam (7) to avoid damage to the seam. All holes in rows 2-7 are loaded with a 25 m column of first explosive (5) at a density of 1300 kg/m$^3$ thus resulting in a powder factor of about 2.9 kg explosive/m$^3$ of unblasted rock in a high energy layer (12). Every second row, and every second hole along these rows, in rows 2-7 is also loaded with a 9 m column of second explosive (6) above the first explosive at a density of 850 kg/m$^3$, thus providing a low energy layer with a powder factor of 0.29 kg explosive/m$^3$ of unblasted rock above the high energy layer. Here, the low energy layer extends from the uppermost ends of the columns of the first explosive (5) to the uppermost ends or collars of the blastholes, which are at the blast surface. Thus the high energy layer extends for 25 m from the toe of the blastholes while the low energy layer extends from the top of the high energy layer to the blast surface, a thickness of about 15 m in the direction perpendicularly away from the high energy layer. All holes are stemmed with inert rock aggregate from the topmost ends of the upper explosive columns to the hole collars.

The blastholes in rows 1 and 8 are drilled on an average or nominal burden (8) and spacing (out of the plane of the Figure) of 8 m and 10 m respectively. These holes are loaded with a 34 m column of second explosive (6) at a density of 850 kg/m$^3$ followed by stemming with inert rock aggregate to the hole collars thus providing low energy buffer zones (11) at both the front (face) and back (highwall) with powder factors of under 0.5 kg explosive/m$^3$ of unblasted rock in these zones. The front (face) buffer row prevents excessive flyrock while the rear buffer row (adjacent to the highwall) provides protection of the highwall from the effects of the high energy zone. Row 1 does not comprise a high energy layer, to avoid flyrock out of the blast free face, while row 8 is adjacent to the new highwall and thus also does not comprise a high energy layer, thus to avoid excessive damage to the new highwall. The new highwall is formed using a technique commonly known as pre-splitting. In this example the presplit (10) has been initiated as a separate blast event some days before the blast, as a lightly charged row of holes on a spacing of 4 m loaded with two decks of 60 kg of explosive each, the decks being separated by an air column. Generally several, for example 5-10, presplit holes are fired simultaneously, with groups of such holes being separated by millisecond delays of the order of 25 ms. Alternatively, the presplit may also be initiated in the same drilling, loading and blasting cycle as the throw blast, usually at least 100 ms before initiation of the nearest blastholes in row 8.

The throw blast is initiated using electronic or nonelectric detonators X. The detonators are towards the toes of the blastholes. Since the columns of first and second explosives are contiguous in those blastholes having both, only one detonator is required in those blastholes. The high energy zone provides for improved blast throw of the overburden to a final spoil position as well as fine fragmentation for improving subsequent overburden removal rates by mechanical excavators, while controlling flyrock and damage to the highwall and blast floor, which here lies on a recoverable coal seam. The nominal inter-row delay times of the holes as shown under each row in the Figure are 150 milliseconds, with an inter-hole delay along rows (not shown, out of the plane of the Figure) of 10 ms in Row 1, 5 ms in Rows 2-6, 15 ms in Row 7 and 25 ms in Row 8.

Another variation of this example is within the same cycle of drilling, loading and blasting, to use a so-called "stand-up" blast below the throw blast containing the high energy layer. Use of such a stand-up blast under a throw blast is disclosed in WO 2005/052499. Such a stand-up blast would be loaded at a powder factor of at least a factor of two lower than the high energy layer; for example less than 1 kg of explosive per cubic meter of unblasted rock in this layer. The stand-up blast would provide another low energy layer, this layer being between the recoverable coal seam and the high energy layer of the throw blast above.

Example 9

Figure 11:
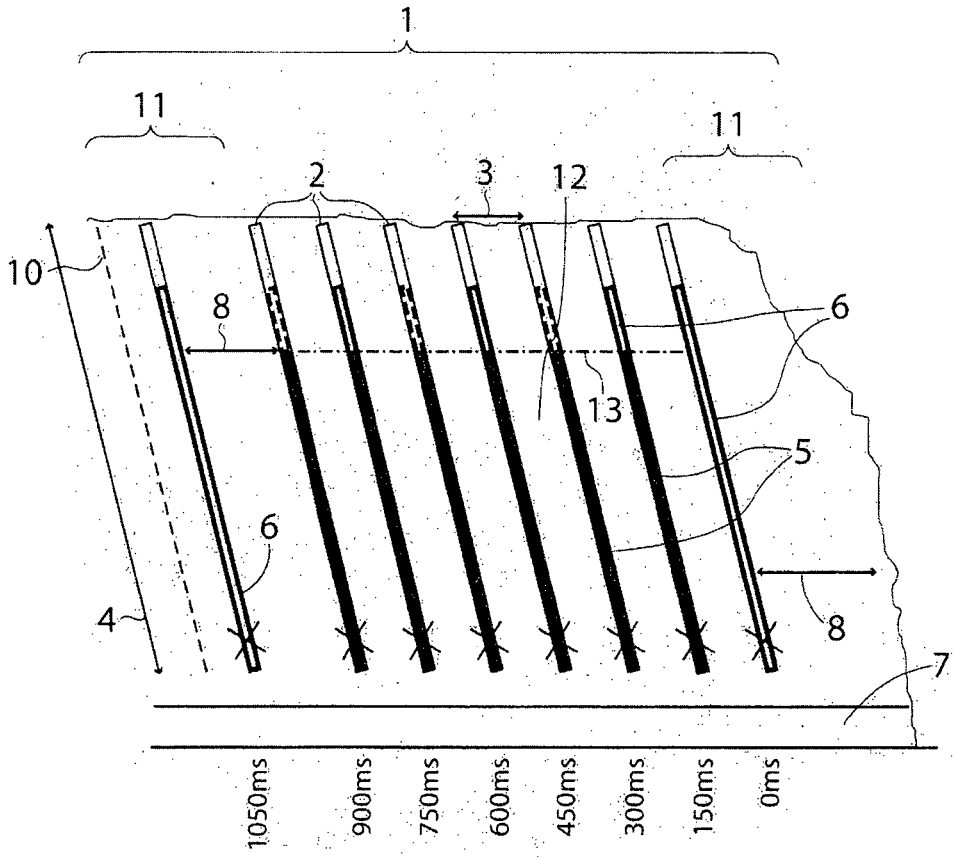
FIG. 11 shows a cross section of another open cut throw blast in accordance with Example 9 of the invention.

This example demonstrates yet another embodiment of the invention, again in this case to provide for more favourable displacement of rock as well as improved fragmentation in an open cut throw blasting situation in a coal mine. Referring to the cross section of the blast zone (1) comprising overburden or waste rock over a lower recoverable coal seam (7) shown in FIG. 11, this blast comprises eight rows (2) of forty blastholes per row in rows 1 and 8 and eighty blastholes per row in rows 2-7 (rows numbered from right to left in FIG. 11). Each blasthole has a nominal diameter of 270 mm. The holes are inclined from the vertical at an angle of 10 degrees. Within this blast is a high energy zone comprising rows 2-7. The average or nominal burdens (3) and spacings (out of the plane of the Figure) in this high energy zone are 7.5 m and 4.5 m respectively. The total blasthole lengths (4) are around 50 m and are drilled only to within 2.5 m of the top of the recoverable coal seam (7) to avoid damage to the seam. All holes in rows 2-7 are loaded with a 40 m column of first explosive (5) at a density of 1050 kg/m$^3$ thus resulting in a powder factor of about 1.78 kg explosive/m$^3$ of unblasted rock in a high energy layer (12). Every second hole along each of rows 2-7 is also loaded with an additional 5 m column of second explosive (6) above the first explosive at a density of 1050 kg/m$^3$, thus providing a low energy layer with a powder factor of about 0.45 kg explosive/m$^3$ of unblasted rock above the high energy layer. In this example, the second explosive is the same explosive type and formulation as the first explosive. The second explosive is loaded directly onto the top of the first explosive and is thus contiguous, forming essentially a single column of explosive charge. Here, the low energy layer extends from the uppermost ends of the columns of the first explosive (5) to the uppermost ends or collars of the blastholes, which are at the blast surface. Thus the high energy layer extends for 40 m from the toe of the blastholes to the top of the first explosive while the low energy layer extends from the top of the high energy layer to the blast surface, a thickness of about 10 m in the direction perpendicularly away from the high energy layer. The demarcation between the high and low energy layers is shown by dashed line (13). All holes are stemmed with inert rock aggregate from the topmost ends of the upper explosive columns to the hole collars.

The blastholes in rows 1 and 8 are drilled on an average or nominal burden (8) and spacing (out of the plane of the Figure) of 7.5 m and 9 m respectively. These holes are loaded with a 45 m column of second explosive (6) at a density of 1050 kg/m$^3$ followed by stemming with inert rock aggregate to the hole. Collars thus providing low energy buffer zones (11) at both the front (face) and back (highwall) with powder factors of about 0.80 kg explosive/m$^3$ of unblasted rock in these zones. The front (face) buffer row prevents excessive flyrock while the rear buffer row (adjacent to the highwall) provides protection of the highwall from the effects of the high energy zone. Row 1 does not comprise a high energy layer to avoid flyrock out of the blast free face, while row 8 is adjacent to the new highwall and thus also does not comprise a high energy layer, thus to avoid excessive damage to the new highwall. The new highwall is formed using a technique commonly known as pre-splitting. In this example the presplit (10) has been initiated as a separate blast event some days before the blast, as a lightly charged row of holes on a spacing of 4 m loaded with two decks of 60 kg of explosive each, the decks being separated by an air column. Generally several, for example 5-10, presplit holes are fired simultaneously, with groups of such holes being separated by millisecond delays of the order of 25 ms. Alternatively, the presplit may also be initiated in the same drilling, loading and blasting cycle as the throw blast, usually at least 100 ms before initiation of the nearest blastholes in row 8.

The throw blast is initiated using electronic or nonelectric detonators X. The detonators are towards the toes of the blastholes. Since the columns of first and second explosives are contiguous in those blastholes having both, only one detonator is required in those blastholes. The high energy zone provides for improved blast throw of the overburden to a final spoil position as well as fine fragmentation for improving subsequent overburden removal rates by mechanical excavators, while controlling flyrock and damage to the highwall and blast floor, which here lies on the recoverable coal seam (7). The nominal inter-row delay times of the holes as shown under each row in the Figure are 150 milliseconds, with an inter-hole delay along rows (not shown, out of the plane of the Figure) of 10 ms in Row 1, 5 ms in Rows 2-6, 15 ms in Row 7 and 25 ms in Row 8.

Another variation of this example is, within the same cycle of drilling, loading and blasting, to use a so-called "stand-up" blast below the throw blast containing the high energy layer. Use of such a stand-up blast under a throw blast is disclosed in WO 2005/052499. Such a stand-up blast would be loaded at a powder factor at least a factor of two lower than the high energy layer, for example less than 0.85 kg of explosive per cubic meter of unblasted rock in this layer. The stand-up blast would provide another low energy layer; this layer being between the recoverable coal seam and the high energy layer of the throw blast above.

Example 10

Figure 12:
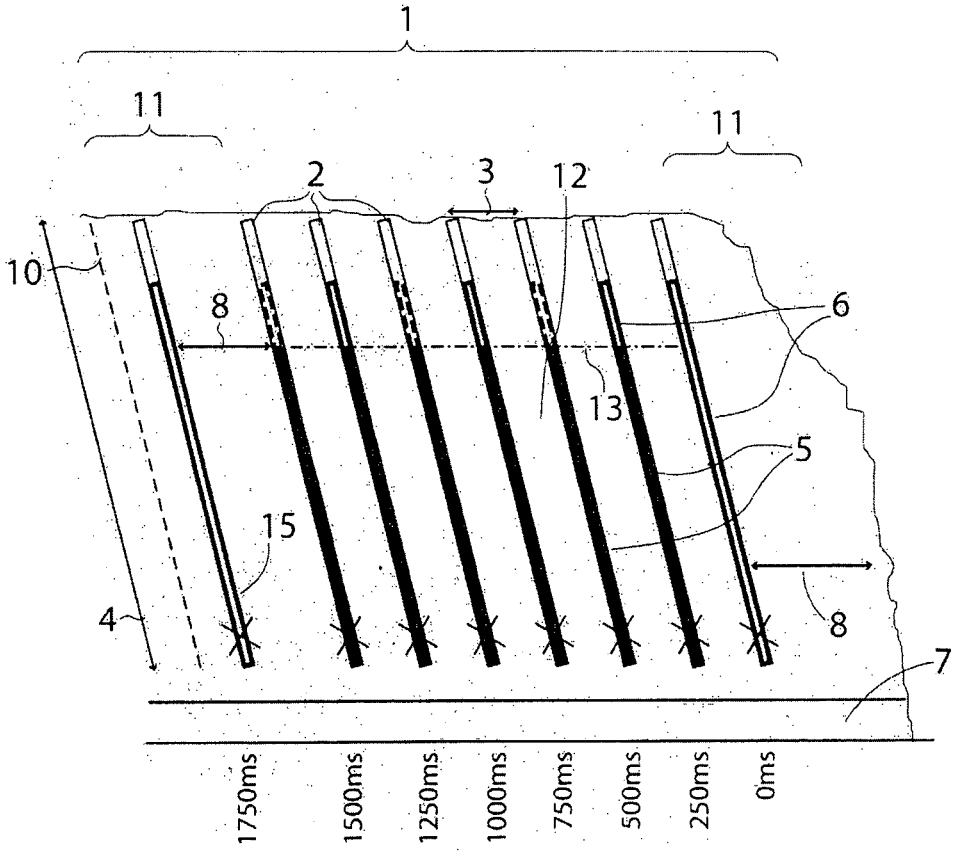
FIG. 12 shows a cross section of yet another open cut throw blast in accordance with Example 10 of the invention.

This example demonstrates yet another embodiment of the invention, again in this case to provide for more favourable displacement of rock as well as improved fragmentation in an open cut throw blasting situation in a coal mine. Referring to the cross section of the blast zone (1) comprising overburden or waste rock over a lower recoverable coal seam (7) shown in FIG. 12, this blast comprises eight rows (2) of forty blastholes per row in rows 1 and 8 and eighty blastholes per row in rows 2-7 (rows numbered from right to left in FIG. 12). Each blasthole has a nominal diameter of 270 mm. The holes are inclined from the vertical at an angle of 20 degrees. Within this blast is a high energy zone comprising rows 2-7. The average or nominal burdens (3) and spacings (out of the plane of the Figure) in this high energy zone are 7.5 m and 4.5 m respectively. The total blasthole lengths (4) are around 50 m and are drilled only to within 2.5 m of the top of the recoverable coal seam (7) to avoid damage to the seam. All holes in rows 2-7 are loaded with a 40 m column of first explosive (5) at a density of 1200 kg/m$^3$ thus resulting in a powder factor of about 2.04 kg explosive/m$^3$ of unblasted rock in a high energy layer (12). Every second hole along these rows, in rows 2-7 is also loaded with an additional 5 m column of second explosive (6) above the first explosive at a density of 1200 kg/m$^3$, thus providing a low energy layer with a powder factor of about 0.51 kg explosive/m$^3$ of unblasted rock above the high energy layer. In this example, the second explosive is the same explosive type and formulation as the first explosive. The second explosive is loaded directly onto the top of the first explosive and are thus contiguous, forming essentially single columns of explosive charge. Here, the low energy layer extends from the uppermost ends of the columns of the first explosive (5) to the uppermost ends or collars of the blastholes, which are at the blast surface. Thus the high energy layer extends for 40 m from the toe of the blastholes to the top of the first explosive while the low energy layer extends from the top of the high energy layer to the blast surface, a thickness of about 9.5 m in the direction perpendicularly away from the high energy layer. The demarcation between the high and low energy layers is shown by dashed line (13). All holes are stemmed with inert rock aggregate from the topmost ends of the upper explosive columns to the hole collars.

The blastholes in rows 1 and 8 are drilled on an average or nominal burden (8) and spacing (out of the plane of the Figure) of 7.5 m and 9 m respectively. The holes in row 1 are loaded with a 45 m column of second explosive (6) at a density of 1050 kg/m$^3$ followed by stemming with inert rock aggregate to the hole collars thus providing a low energy buffer zone (11) at the front (face) with a powder factors of about 0.87 kg explosive/m$^3$ of unblasted rock. The holes in row 8 are loaded with a 45 m column of third explosive (15) of ANFO-type at a density of 850 kg/m$^3$ followed by stemming with inert rock aggregate to the hole collars thus providing and a low energy buffer zone (14) at the back (wall area) with a powder factors of about 0.6 kg explosive/m$^3$ of unblasted rock. The front (face) buffer row prevents excessive flyrock while the rear buffer row (adjacent to the highwall) provides protection of the highwall from the effects of the high energy zone. Row 1 does not comprise a high energy layer to avoid flyrock but of the blast free face, while row 8 is adjacent to the new highwall and thus also does not comprise a high energy layer, thus to avoid excessive damage to the new highwall. The new highwall is formed using a technique commonly known as pre-splitting. In this example the presplit (10) has been initiated as a separate blast event some days before the blast, as a lightly charged row of holes on a spacing of 4 m loaded with two decks of 60 kg of explosive each, the decks being separated by an air column. Generally several, for example 5-10, presplit holes are fired simultaneously, with groups of such holes being separated by millisecond delays of the order of 25 ms. Alternatively, the presplit may also be initiated in the same drilling, loading and blasting cycle as the throw blast, usually at least 100 ms before initiation of the nearest blastholes in row 8.

The throw blast is initiated using electronic or nonelectric detonators X. The detonators are towards the toes of the blastholes. Since the columns of first and second explosives are contiguous in those blastholes having both, only one detonator is required in those blastholes. The high energy zone provides for improved blast throw of the overburden to a final spoil position as well as fine fragmentation for improving subsequent overburden removal rates by mechanical excavators, while controlling flyrock and damage to the highwall and blast floor, which here lies on the recoverable coal seam (7). The nominal inter-row delay times of the holes as shown under each row in the Figure are 250 milliseconds, with an inter-hole delay along rows (not shown, out of the plane of the Figure) of 10 ms in Row 1, 5 ms in Rows 2-6, 15 ms in Row 7 and 25 ms in Row 8.

Figure 13:
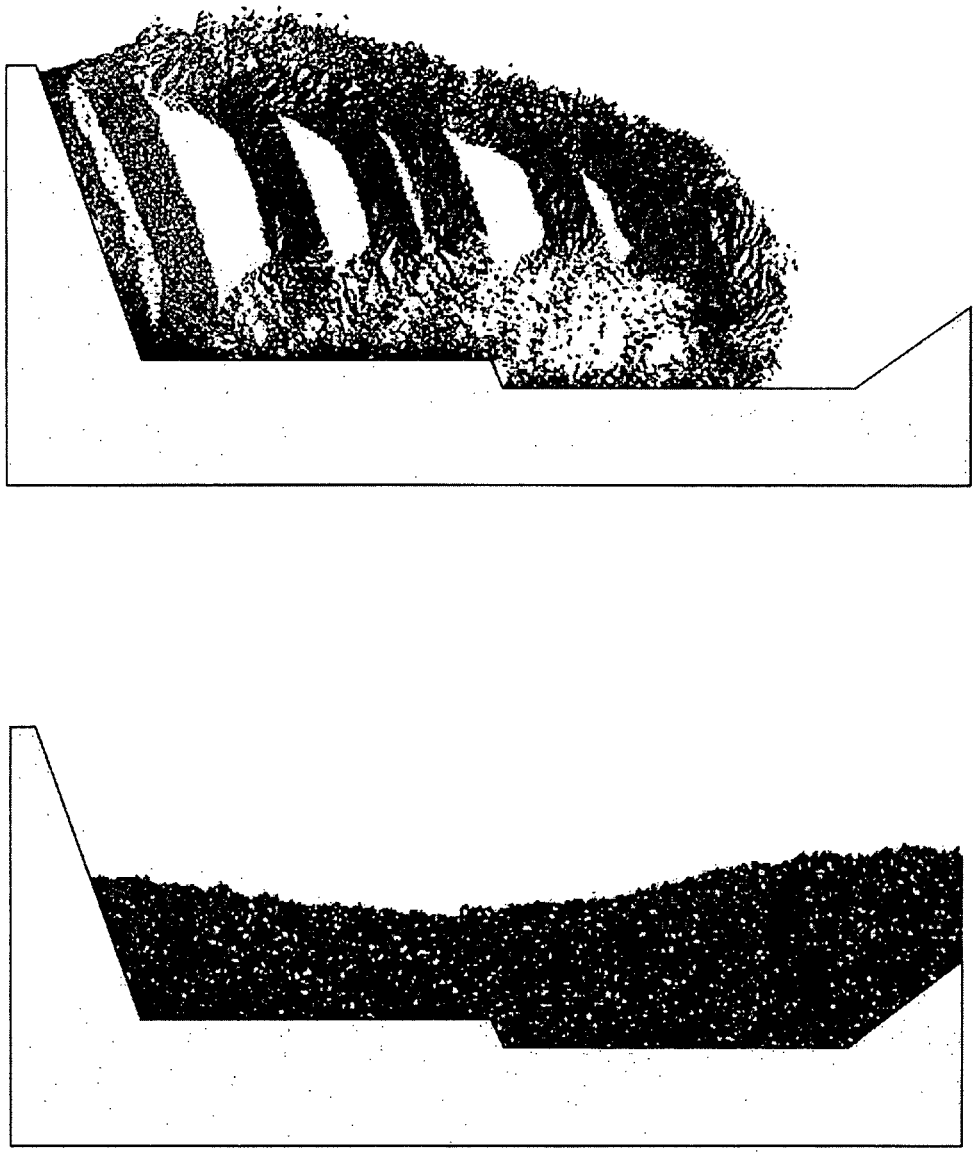
FIG. 13 shows output from the SoH blast model of the throw blast of Example 10.

This high energy throw blast was modelled using the advanced blasting model named. SoH. Output from the model is shown in FIG. 13, with the top part of the Figure showing the throw blast in progress and the bottom part of the Figure showing the completed throw blast. It is demonstrated that the blast does not produce uncontrolled flyrock or rock ejection from the blast area but still results in an unconventionally large degree of blast throw. From the model, the percentage of material thrown into a final spoil position, known as "percentage throw" was measured to be in excess of 55%, in comparison to a conventional throw blast in the same blast geometry and rock that produced only about 25% throw.

Another variation of this example is, within the same cycle of drilling, loading and blasting, to use a so-called "stand-up" blast below the throw blast containing the high energy layer. Use of such a stand-up blast under a throw blast is disclosed in WO 2005/052499. Such a stand-up blast would be loaded at a powder factor at least a factor of two lower than the high energy layer; for example less than 1 kg of explosive per cubic meter of unblasted rock in this layer. The stand-up blast would provide another low energy layer; this layer being between the recoverable coal seam and the high energy layer of the throw blast above.

Example 11

Figure 14:
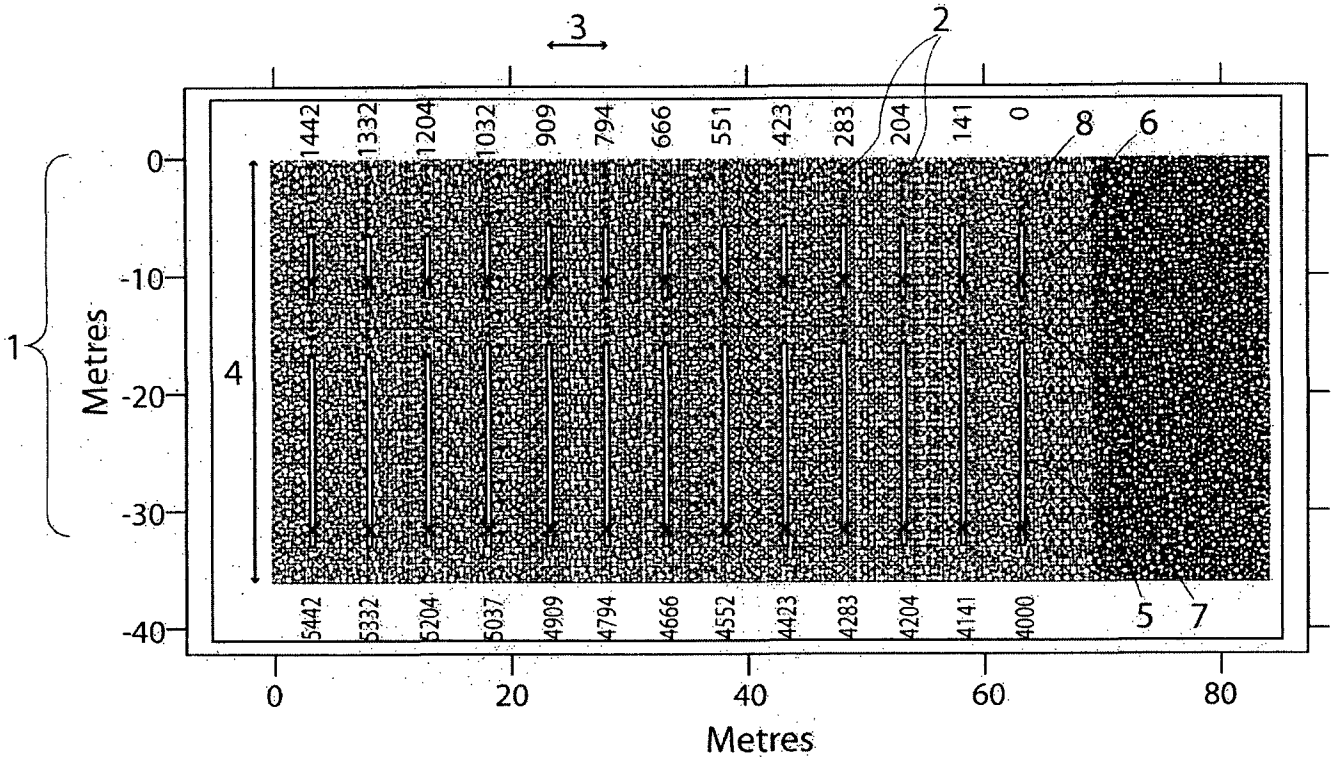
FIG. 14 is a schematic illustration of an embodiment of an open cut blast in accordance with Example 11 of the invention.

This example is one for a large copper mine in South America. Conventionally, the mine utilises 16 m bench heights. In order to maximise productivity, the high energy blasting method is applied here to a double-bench situation; thus using bench heights of 32 m for each blast. Using an embodiment of the invention. FIG. 14, which illustrates the vertical and horizontal depth of the blast in meters, shows such a blast in a 32 m bench (1) comprising thirteen rows (2) of thirty blastholes per row each with a nominal diameter of 311 mm. Within this blast is a high energy zone comprising all the rows. The average or nominal burdens (3) and spacings (out of the plane of the Figure) in this zone are 5 m and 5 m respectively. The total blasthole depths (4) are around 33 m, using 1 m of subdrill below the design bench depth of 32 m from the surface. The holes in each row are loaded with a 17 m column of first explosive (5) at a density of 1250 kg/m$^3$. Every hole is also loaded with a 4 m column of inert stemming material (7) above the column of first explosive and then a 6 m column of a second explosive (6) at a density of 1250 kg/m$^3$. This second explosive is the same type and density of explosive as the first explosive, namely a heavy ANFO formulation. All blastholes are stemmed from tops of the uppermost explosives columns to the surface with inert stemming material (8).

This loading provides for a powder factor of about 5.1 kg explosive per m$^3$ of unblasted rock in the high energy layer, which extends from the base or design floor of the blast field to the tops of the column's of first explosive at 17 m from the toes of the blastholes. It also provides for a powder factor of about 1.81 kg explosive pet m$^3$ of unblasted rock in the low energy layer, which extends from the tops of the columns of first explosive at 17 m from the toes of the blastholes to the upper collar ends of the blastholes at the surface of the blast. This provides a powder factor in the low energy layer that is a factor of 2.8 times lower than that in the high energy layer. The powder factor in the high energy layer, which as defined in this invention is delimited by planes joining the bottommost ends of the blastholes and planes joining the topmost ends of the columns of first explosive, is calculated based on a loading of 2057 kg in each column of first explosive and a volume of unblasted rock of (5 m×5 m×16 m), or 400 m$^3$ of unblasted rock per hole. The powder factor in the low energy layer, which as described in this invention is delimited by the top of the high energy layer and by planes joining the topmost or collar ends of adjacent blastholes (in this case the top of the bench), is calculated based on a loading of 725 kg in each column of second explosive and a volume of unblasted rock of (5 m×5 m×16 m), or 400 m$^3$ of unblasted rock per hole. A body of buffer material comprising previously blasted rock is shown in a darker shade of grey, extending from the face of the blast (at 0 m).

Also shown in FIG. 14 are the nominal initiation (inter-row delay) times of the holes in milliseconds at the detonators X, with an inter-hole delay along rows (not shown, out of the plane of the Figure) of 25 ms being used.

Figure 15:
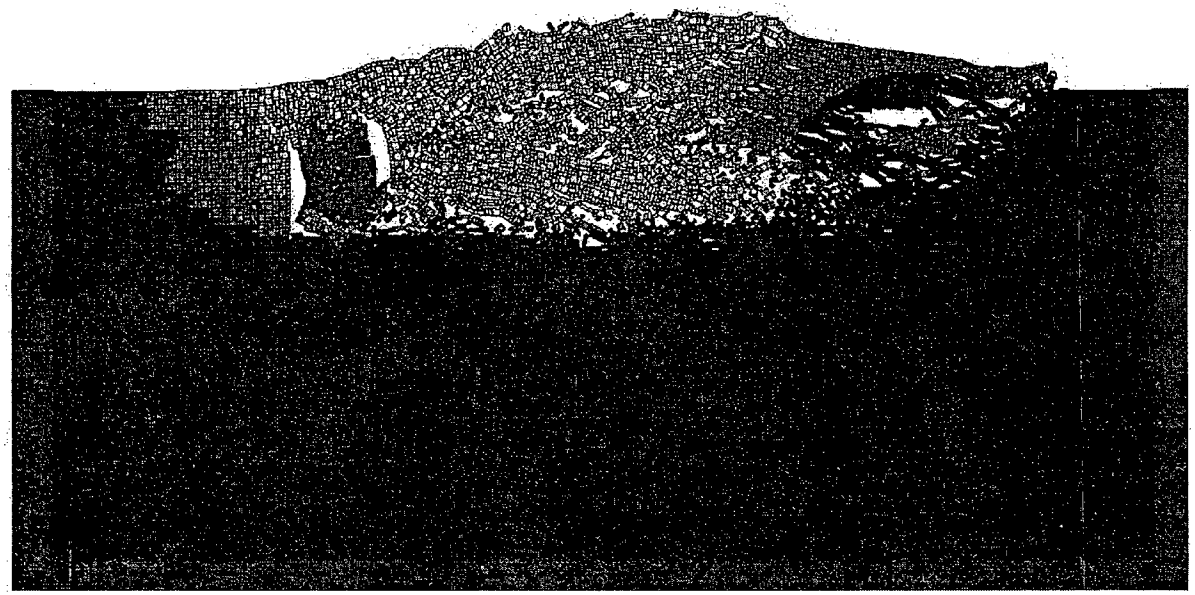
FIGS. 15 and 16 show output from the SoH blast model of the blast of Example 11.
Figure 16:
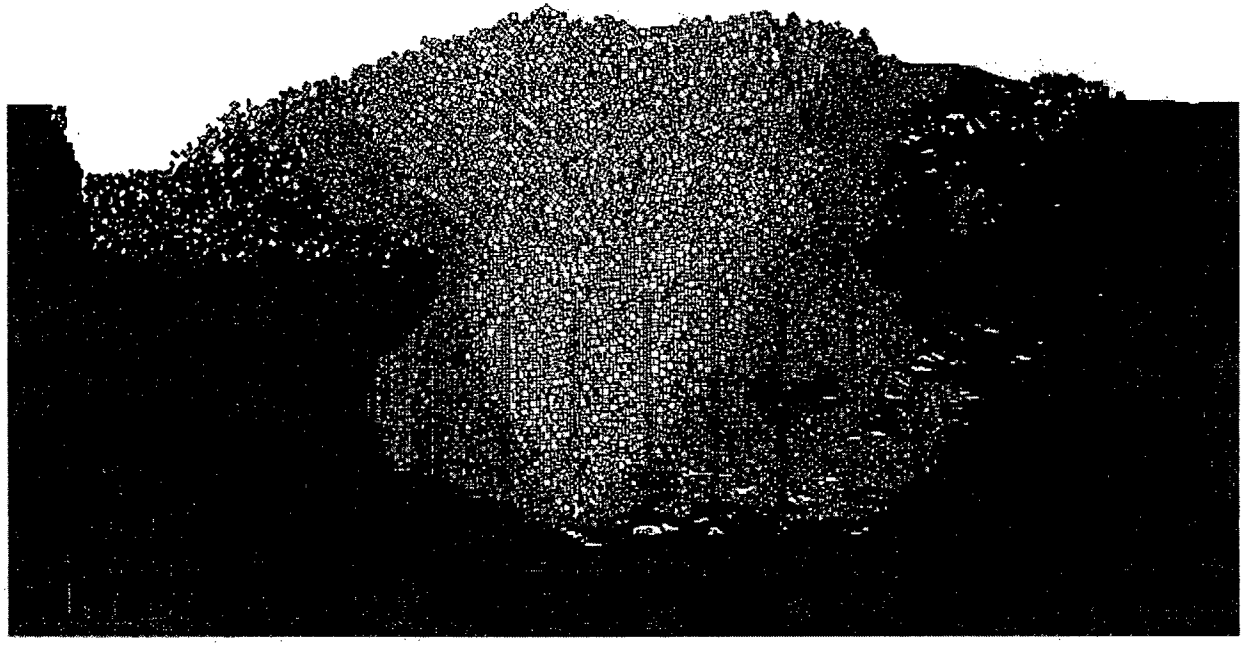

In this example the blast is initiated using electronic detonators in each deck of explosive, indicated with a cross in the figure, providing the inter-hole and inter-row delays as specified. However, the decks in the high energy layer are initiated after a delay of 4000 ms after the nearest deck in the low energy layer has initiated. In this case the nearest decks in the low energy layer to the decks in the high energy layer are the decks that are present within the same blastholes. FIGS. 15 and 16 illustrate the modelled outcome of this design using the blast model SoH. FIG. 15 shows the upper low energy layer being initiated with a maximum vertical displacement of only about 8 m. FIG. 16 shows the lower high energy layer being initiated some four seconds after the low energy layer. The maximum vertical displacement here is again only about 8 m. It is seen that excellent control is obtained using this embodiment of the invention, providing for a powder factor of in excess of 5.1 kg/m$^3$ of unblasted rock in the high energy layer.

It will be understood by those skilled in the art that the high and low energy layers of Examples 3, 4b, 5, 6, 7, 8, 9, 10 and 11 may also be achieved by various other combinations of blasthole diameters, explosive densities and column lengths and blasthole burdens and spacings, provided that the high energy layer has a powder factor of at least 1.75 kg of explosive per cubic meter of unblasted rock and the low energy layer has a powder factor at least a factor of two lower than the high energy layer. For example, in Examples 3, 4b, 6, 7, 8, 9, 10 and 11 the high and low energy layers may be achieved by the application of one of the techniques of Example 5; namely the use of larger diameters in the blasthole portions in the high energy layer and smaller diameters in the blasthole portions in the low energy layer. Alternatively, separate larger diameter holes may be used for providing the high energy layer and separate smaller diameter blastholes may be used to provide the low energy layer.

Those skilled in the art will appreciate that the invention described herein is susceptible to variations and modifications other than those specifically described. It is to be understood that the invention includes all such variations and modifications which fall within its spirit and scope. The invention also includes all the steps and features referred to or indicated in this specification, individually or collectively, and any and all combinations of any two or more of said steps or features.

The reference in this specification to any prior publication or information derived from it), or to any matter which is known, is not and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The invention claimed is:

1. In mining for recoverable mineral, a method of blasting rock comprising drilling blastholes in a blast zone, loading the blastholes with explosives and then firing the explosives in the blastholes in a single cycle of drilling, loading and blasting, wherein the blast zone comprises a high energy blast zone in which blastholes are partially loaded with a first explosive to provide a high energy layer of the high energy blast zone having a powder factor of at least 1.75 kg of explosive per cubic meter of unblasted rock in the high energy layer and in which at least some of those blastholes are also loaded with a second explosive to provide a low energy layer of the high energy blast zone between the high energy layer and the adjacent end of those blastholes, said low energy layer having a powder factor that is at least a factor of two lower than the powder factor of said high energy layer.

2. A method according to claim 1, wherein the low energy layer has a powder factor of at most 2.0 kg of second explosive per cubic meter of unblasted rock in the low energy layer.

3. A method according to claim 1, wherein the low energy layer has a powder factor of at most 1.5 kg of second explosive per cubic meter of unblasted rock in the low energy layer.

4. A method according to claim 1, wherein the low energy layer has a depth or thickness, in the direction perpendicularly away from the high energy layer, of at least 2 m.

5. A method according to claim 1, wherein the high energy layer has a powder factor of at least 2 kg of first explosive per cubic meter of unblasted rock in the high energy layer.

6. A method according to claim 1, wherein the high energy layer has a powder factor of at least 2.5 kg of first explosive per cubic meter of unblasted rock in the high energy layer.

7. A method according to claim 1, wherein the high energy layer has a powder factor of up to 20 kg of first explosive per cubic meter of unblasted rock in the high energy layer.

8. A method according to claim 1, wherein at least those blastholes in the high energy zone loaded with both first explosive and second explosive have a first diameter portion loaded with the first explosive and a second diameter portion loaded with the second explosive, and wherein the first diameter is greater than the second diameter.

9. A method according to claim 1, wherein the first explosive has a greater density than the second explosive.

10. A method according to claim 1, wherein the first explosive has a greater blast energy per unit mass than the second explosive.

11. A method according to claim 1, wherein the first explosive has a greater blast velocity of detonation than the second explosive.

12. A method according to claim 1, wherein the first explosive is the same as the second explosive.

13. A method according to claim 1, wherein at least some of those blastholes in the high energy zone loaded with both first explosive and second explosive have at least one inert deck of stemming or air in the low energy layer.

14. A method according to claim 1, wherein there are blastholes in the high energy zone loaded with first explosive but not with second explosive, and wherein those blastholes have at least one inert deck of stemming or air in the low energy layer between the high energy layer and the adjacent end of those blastholes.

15. A method according to claim 1, wherein the step of blasting in the high energy zone comprises firing the explosives in the high and low energy layers sequentially.

16. A method according to claim 15, wherein the first explosive in the high energy layer is fired after the second explosive in the low energy layer.

17. A method according to claim 15, wherein the blasting of the second explosive in the low energy layer results in a blanket of blasted material over the high energy layer.

18. A method according to claim 15, wherein any charge of the explosive to be fired in one of the high and low energy layers is fired at least about 500 ms after firing the nearest charge of the explosive in the other of the high and low energy layers.

19. A method according to claim 18, wherein a first charge of the explosive to be fired in said one of the high and low energy layers is fired at least about 500 ms after firing the last charge of the explosive in said other of the high and low energy layers.

20. A method according to claim 1, wherein the blasting is in an open cut mine in which the blastholes extend downwardly and the high energy layer is beneath the low energy layer.

21. A method according to claim 20, wherein the first explosive in the high energy layer is offset from a toe of the blastholes or from the design blast floor level in the high energy blast zone.

22. A method according to claim 21, wherein at least some of the blastholes in the high energy blast zone loaded with first explosive are also loaded with further explosive to provide a second low energy layer between the high energy layer and the toes of the blastholes in the high energy blast zone, said second low energy layer having a powder factor that is at least a factor of two lower than the powder factor of the high energy layer.

23. A method according to claim 22, wherein the second low energy layer has a powder factor of at most 1.5 kg of explosive per cubic meter of unblasted rock in the second low energy layer.

24. A method according to claim 1, wherein the blasting is in an underground mine and the first explosive and the second explosive are loaded, respectively, closer to a collar of the blastholes and closer to a toe of the blastholes.

25. A method according to claim 24, wherein the first explosive in the high energy layer is offset from a collar of the blastholes in the high energy blast zone.

26. A method according to claim 25, wherein at least some of the blastholes in the high energy blast zone loaded with first explosive are also loaded with further explosive to provide a second low energy layer between the high energy layer and the collars of the blastholes in the high energy blast zone, said second low energy layer having a powder factor that is at least a factor two lower than the powder factor of the high energy layer.

27. A method according to claim 26, wherein the second low energy layer has a powder factor of at most 1.5 kg of explosive per cubic meter of unblasted rock in the second low energy layer.

28. A method according to claim 1, wherein the blast zone has a perimeter, and the high energy blast zone is isolated from the perimeter by a low energy blast zone comprising blastholes that are drilled, loaded and blasted in said single cycle, said blastholes in the low energy blast zone being loaded with explosive to provide a powder factor that is at least a factor of two lower than the powder factor of the high energy layer of the high energy blast zone.

29. A method according to claim 28, wherein the low energy blast zone has a powder factor of at most 1.5 kg of explosive per cubic meter of unblasted rock in the low energy blast zone.

30. A method according to claim 28, wherein the low energy blast zone extends entirely around the high energy blast zone.

31. A method according to claim 28, wherein the explosives in the high energy blast zone are fired after at least the nearest explosive in the low energy blast zone has been fired.

32. A method according to claim 31, wherein the explosives in the high energy blast zone are fired at least about 500 ms after at least the nearest explosive in the low energy blast zone has been fired.

33. A method according to claim 31, wherein the explosives in the high energy blast zone are fired after all of the explosive in the low energy blast zone has been fired.

34. A method according to claim 33, wherein the explosives in the high energy blast zone are fired at least about 500 ms after all of the explosive in the low energy blast zone has been fired.

35. A method according to claim 1, wherein the recoverable mineral is metalliferous.

36. A method according to claim 1, wherein the explosives are initiated using electronic delay detonators.

37. A method according to claim 1, wherein the first and second explosives in any one blasthole are fired at the same time.

38. A method according to claim 37, wherein columns of the first and second explosives in said any one blasthole are contiguous.

39. A method according to claim 17, wherein the method results in the rock blasted in the high energy blast zone remaining within the high energy blast zone.

* * * * *